US007270062B1

(12) United States Patent
Larson

(10) Patent No.: US 7,270,062 B1
(45) Date of Patent: Sep. 18, 2007

(54) USER HEIGHT ADJUSTABLE TABLES, SUPPORT STRUCTURES, AND CHAIRS

(76) Inventor: John E. Larson, P.O. Box 1197, Hamilton, MT (US) 59840

( * ) Notice: Subject to any disclaimer, the term of this patent is extended or adjusted under 35 U.S.C. 154(b) by 0 days.

(21) Appl. No.: 09/566,215

(22) Filed: May 5, 2000

Related U.S. Application Data

(63) Continuation-in-part of application No. 09/348,618, filed on Jul. 6, 1999, and a continuation-in-part of application No. 09/173,236, filed on Oct. 15, 1998, now Pat. No. 6,182,583, which is a continuation-in-part of application No. 08/925,088, filed on Sep. 8, 1997, now Pat. No. 6,116,690.

(60) Provisional application No. 60/132,716, filed on May 6, 1999.

(51) Int. Cl.
*A87B 9/00* (2006.01)

(52) U.S. Cl. ..... 108/147; 108/150; 248/404; 248/161

(58) Field of Classification Search ..... 108/147, 108/150; 248/404, 422, 161
See application file for complete search history.

(56) References Cited

U.S. PATENT DOCUMENTS 4,526,334 A 7/1985 Rantakari
5,230,290 A * 7/1993 Crossman ..... 108/147
5,437,236 A * 8/1995 Zeiner ..... 108/147
5,553,550 A * 9/1996 Doyle ..... 108/147 X
5,802,988 A * 9/1998 Shields ..... 108/147 X
6,021,722 A 2/2000 Raycraft
2002/0011193 A1 1/2002 Beck et al.

FOREIGN PATENT DOCUMENTS

DE 88 04 868.3 7/1988
JP 9068889 2/1997

* cited by examiner

*Primary Examiner*—Anthony D. Barfield

(57) ABSTRACT

A height adjustable structure comprises a base, a height adjustment column disposed above the base and supported thereon, and a table top or chair seat support disposed above the height adjustment column. Alternatively the height adjustable structure comprises two or more base sections, a height adjustment column disposed above each base section and supported thereon, and a table top or chair seat support disposed above the height adjustment columns. Each height adjustment column comprises a telescoping spring height adjustment lifting mechanism. The telescoping spring height adjustment lifting mechanism is typically a gas spring. Actuation mechanisms which actuate or unlock each lockable telescoping spring height adjustment lifting mechanism are used to allow the user to easily make height adjustments. The actuation mechanisms may extend above the table top. Connecting bars may be used to connect more than one actuation mechanism.

38 Claims, 19 Drawing Sheets

USER HEIGHT ADJUSTABLE TABLES, SUPPORT STRUCTURES, AND CHAIRS

RELATED APPLICATIONS

The present application is a continuation-in-part of U.S. patent application Ser. No. 09/173,236 filed Oct. 15, 1998 entitled "Height Adjustable Pedestal for Chairs and Tables", now U.S. Pat. No. 6,182,583, which is a continuation-in-part of U.S. patent application Ser. No. 08/925,088 filed Sep. 8, 1997 entitled "Height Adjustable Work Chair Having a Non-Swivel Seat", now U.S. Pat. No. 6,116,690, by the same inventor as the present application. These applications are incorporated herein by this reference. The present application is also a continuation-in-part of co-pending U.S. patent application Ser. No. 09/348,618 filed Jul. 6, 1999 entitled "Height Adjustable Furniture Columns Including Actuation Mechanisms" by the same inventor as the present application. That application is also incorporated herein by this reference. The present application claims the benefit under 35 U.S.C. 119E of U.S. Provisional Patent Application Ser. No. 60/132,716 filed May 6, 1999 entitled "Height Adjustable Pedestal and Tables Including Actuation Mechanisms" by the same inventor as the present application.

BACKGROUND AND SUMMARY

The present invention solves the need for an inexpensive height adjustable pedestal which may be used in tables and chairs. The present invention typically uses at least two inexpensive telescoping spring height adjustment lifting mechanisms which may be locked at various heights. The telescoping spring height adjustment lifting mechanisms used in the present invention are typically gas springs which utilize an internal pressurized gas as the spring. In these gas springs, the pressurized gas is sealed within the cylinder section of the mechanism. The pressurized gas pushes on a piston section of the mechanism. The piston is axially aligned within the cylinder. Alternatively, telescoping spring height adjustment lifting mechanisms, which use a metal coil sealed within a cylinder as the spring and a fluid filled cartridge as the locking mechanism, may also be used. In this version the metal coil pushes on a piston which is axially aligned within the cylinder. An example of this type of spring mechanism is shown in U.S. Pat. No. 5,078,351 which is incorporated herein by this reference. In either of these versions, an actuation button on the cylinder of the telescoping spring height adjustment lifting mechanism is used to actuate or unlock the mechanism. In the actuated condition, a height adjustment may be made either by compressing the spring or by allowing a compressed spring to extend. During these height adjustments the telescopic sections of the telescoping spring mechanism move relative to each other as the spring is compressed or as a compressed spring extends. In gas springs, the actuation button is an extension of an internal gas flow control valve which allows pressurized gas to move through the valve.

The present invention uses two or more telescoping spring height adjustment lifting mechanisms to support the table top, chair seat, or other furniture component. The loads on the table top, chair seat, or other furniture component are therefore distributed over more than one telescoping spring lifting mechanism.

It has been recognized that there is difficulty in using a telescoping spring mechanism in a height adjustable pedestal due to binding or jamming problems caused within the telescoping spring mechanism. The problem arises from off center or lateral loads which may typically be placed on the table top at a lateral distance from the telescoping spring mechanism. The off center or lateral loads result in bending moment forces on the telescoping spring mechanism. The bending moments cause the telescopic sections of the telescoping spring mechanism to move out of axial alignment. Once the telescopic sections have moved out of axial alignment, the telescoping sections bind against each other. Telescoping movement of the telescopic sections is resisting by the binding.

There have been attempts at solving the binding problem inherent in the use of a telescoping spring mechanism in tables and chairs. These attempts have included the use of telescoping bracing mechanisms which are used in addition to the telescoping spring mechanism. The telescoping bracing mechanisms act to resist the bending moments which would otherwise bind or jam the telescoping spring mechanism. A height adjustable table that includes telescoping bracing mechanisms is shown in U.S. Pat. No. 4,381,714. In the description of prior art in this patent, there is discussed the problems encountered when using a telescoping spring mechanism in a height adjustable pedestal. The patent describes the binding problems which are caused by the placement of a load in an off center or lateral position relative to the telescoping spring mechanism. In the table shown in U.S. Pat. No. 4,381,714 the binding problem was addressed by the use of a pair of telescoping bracing mechanisms. The telescoping bracing mechanisms use sliding ball bearing guides. The telescoping bracing mechanism resist bending moments caused by off center or lateral loads. The resistance of bending moments on the telescoping spring mechanism minimizes any axial mis-alignment that could result in the telescopic sections of the telescoping spring mechanism. By minimizing axial mis-alignment, the bracing mechanisms ensure that the telescoping spring mechanism will not bind or jam.

The telescoping bracing mechanisms, as shown in U.S. Pat. No. 4,381,714 do not use a spring and do not contribute to the lifting forces applied to the table top, but only serve as guides. The telescoping bracing mechanisms do not support the table top in any way other than resisting the bending moments that would otherwise bind or jam the telescoping spring mechanism.

It is believed in the industry that the binding problems encountered when using a single telescoping spring mechanism would be worsened if more than one telescoping spring mechanism were used. Because of this belief, additional mechanisms other than telescoping spring mechanisms have been used to brace the telescoping spring mechanism against bending moments to minimize the binding problem. This is shown in the previously mentioned U.S. Pat. No. 4,381,714. There is no evidence in the prior art of the use of more than one telescoping spring mechanism where a load is distributed between the telescoping spring mechanisms.

The present invention allows the load of a table top, as well as any additional load placed on the table top, to be distributed to more than one telescoping spring mechanism. Similarly, the present invention allows the load of a chair seat, as well as any additional load placed on the chair seat, to be distributed to more than one telescoping spring mechanism. Height adjustments made to a table top, chair seat, or other furniture component which is supported by the pedestal of the present invention, are made by the combined lifting forces of more than one telescoping spring mechanism. Each telescoping spring mechanism contributes to the combined lifting forces applied to the table top, chair seat, or other furniture component. During the lifting of the table top, chair seat, or other furniture component, as well as during normal use of the table top, chair seat, or other furniture component when no height adjustments are made, the downward forces resulting from the table top, chair seat, or other furniture component are distributed over each telescoping spring mechanism. These features are not shown in the prior art.

Through the use of more than one telescoping spring mechanism the present invention not only distributes the forces on the table top or chair seat over more than one mechanism, as previously mentioned, but the present invention in using more than one telescoping spring mechanism also solves the binding problem. It has been determined that the use of more than one telescoping spring mechanism greatly reduces the binding problem, instead of exacerbating the problem. The additional telescoping spring mechanisms do not only function as additional lifting mechanisms which also support the table top or chair seat, but as well act to laterally stabilize the lifting of the table top or chair seat during height adjustments. The additional telescoping spring mechanisms also function as braces to ensure that off center or lateral loads on the table top or chair seat will not cause the mis-alignment of telescopic sections of the telescoping spring mechanisms resulting in binding. Loads may be placed at various locations on the table top, chair seat or other furniture component while ensuring that the height adjustment feature continues to operate properly. This use of a plurality of telescoping spring lifting mechanisms which serve as lifting supports for a table top or chair seat, as well as serving as braces for the other telescoping spring mechanisms is not shown in the prior art.

The benefits of the present invention are very pronounced in variations of the invention where the telescoping spring mechanisms are maintained within the pedestal at a significant spaced apart configuration. In these pedestal configurations, the telescoping spring mechanisms, the base sections which support the telescoping spring mechanisms, and the table top supports which are disposed above the telescoping spring mechanisms, are all placed at a spaced apart configuration which resist the bending moment forces applied by off center or lateral loads on the telescoping spring mechanisms which would cause binding. The benefits are also due to decreased bending moments as loads would necessarily be placed at a closer proximity to the lifting mechanisms. Accordingly, many more load placement locations are available on the table tops of the present invention as compared to pedestals using a single telescoping spring mechanism.

Due to the spaced apart attachment points of the height adjustable columns to the table top and to the base sections, a high level of stability is provided to the table. The stability of this configuration is considerably higher than a configuration where a single attachment point exists between a height adjustable pedestal and the table top. The high level of stability is yet another benefit provided by the present invention.

The present invention provides various actuation mechanisms which are used to unlock height adjustable tables or pedestals. The actuation mechanisms disclosed herein may be used to actuate a single locking telescoping spring mechanism. The actuation mechanisms also may be connected so that two or more telescoping spring mechanisms may each be actuated by a single mechanism.

The actuation mechanisms provide significant ergonomic benefits to height adjustable tables using locking telescoping spring mechanisms. The actuation mechanisms are designed for placement on the table at positions which are convenient for the user. The actuation mechanisms are very simple in use. Users of height adjustable chairs will readily understand the operation of the tables. The actuation mechanisms are also designed so that the shape of the elements within the mechanism which will be handled by the user are designed to accommodate the movement that the user will perform while operating the actuation mechanism. For example, if the user will be assisting the telescoping spring mechanism while the mechanisms are being actuated, the actuation mechanism is designed to allow the user to grasp ergonomic designed handles on the actuation mechanism which are in a proper position for the user to simultaneously actuate the telescoping spring mechanism and assist the lifting the table top. Similarly, if the user will be pressing downward on the table top while actuating the telescoping spring mechanism, the ergonomic designed handles are designed to allow the user to perform both functions simultaneously.

DRAWINGS

DESCRIPTION

Figure 1:
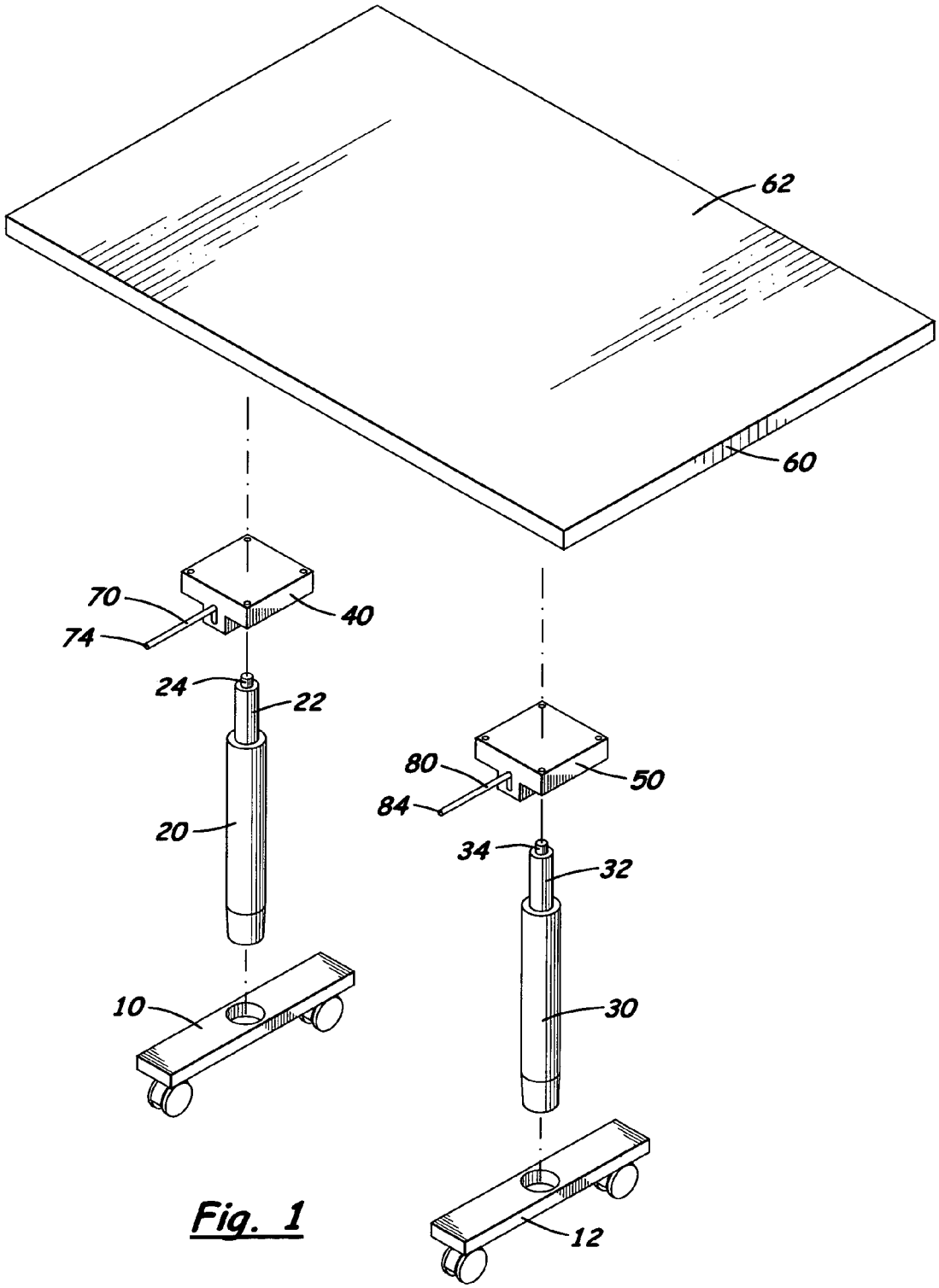
FIG. 1 is an exploded perspective view of a version of the invention.

FIG. 1 shows in an exploded view a first version of the height adjustable table of the present invention. As shown, the height adjustable table comprises: a floor contacting base including a first base section 10, and a second base section 12; a first height adjustable column 20 disposed vertically above the first base section 10 and supported by the first base section; and, a second height adjustable column 30 disposed vertically above the second base section 12 and supported by the second base section. The first height adjustable column includes a lockable telescoping spring height adjustment lifting mechanism 22. The second height adjustable column comprises a lockable telescoping spring height adjustment lifting mechanism 32. A first table top support 40 is disposed vertically above the first height adjustable column 20, and is supported by the first height adjustable column. A second table top support 50 is disposed vertically above the second height adjustable column 30, and is supported by the second height adjustable column. The table top supports are adapted for support of a table top 60.

The first and second table top support mechanisms may be construed as part of the height adjustable columns. Alternatively, the first and second table top support mechanisms may be construed as separate components for disposal above the height adjustable columns. Although not shown explicitly herein, the height adjustable columns may include a telescoping structure which includes an upper telescoping section. In this instance the upper telescoping section would comprise the table top support mechanism. Such a height adjustable column was shown previously in co-pending U.S. patent application Ser. No. 09/348,618 filed Jul. 6, 1999 entitled "Height Adjustable Furniture Columns Including Actuation Mechanisms" by the same inventor as the present application. That application is incorporated herein.

The table top 60 is disposed vertically above the table top supports and is supported by the table top supports. The table top includes a top surface 62 and a bottom surface (not shown).

Both of the locking telescoping spring height adjustment lifting mechanisms include a resilient spring material which in this version is compressed gas. Both lockable telescoping spring height adjustment lifting mechanisms also include a moveable actuation button 24 and 34. The movable actuation button is selectively movable from a first locked position to a second unlocked position. Both lockable telescoping spring height adjustment lifting mechanisms must be actuated to adjust the height of the table top relative to the floor.

The height adjustable table includes an actuation mechanism for unlocking each of the lockable telescoping spring height adjustment lifting mechanisms. Specifically the actuation mechanism engages and moves the actuation buttons 24 and 34 of the lockable telescoping spring height adjustment lifting mechanisms.

Upon the actuation of each lockable telescoping spring height adjustment lifting mechanism, the resilient spring material of each telescoping spring height adjustment lifting mechanism may be compressed. Also upon actuation, the resilient spring material of each telescoping spring height adjustment lifting mechanism, if compressed, will resiliently expand unless a sufficient compressive force is applied to the telescoping spring height adjustment lifting mechanisms.

The actuation mechanism for engaging and moving the actuation button of each lockable telescoping spring height adjustment lifting mechanism is a first height adjustment lever 70 and a second height adjustment lever 80. As will be shown in FIG. 3, the first height adjustment lever includes a first portion which extends to the actuation button of the first lockable telescoping spring height adjustment lifting mechanism of the first height adjustable column. Additionally the second height adjustment lever 80 includes a first portion which extends to the actuation button of the first lockable telescoping spring height adjustment lifting mechanism of the second height adjustable column.

The first height adjustment lever 70 is supported by the first table top support 40. The second height adjustment lever 80 is supported by the second table top support 50. The first and second height adjustment levers each include a second portion 74 and 84 which is accessible to the table user.

The actuation and resilient expansion of compressed spring material of each of the telescoping spring height adjustment lifting mechanisms results in an upward force applied to the table top causing the rising of the table top. Both telescoping spring height adjustment lifting mechanisms contribute to the lifting forces applied to the table top.

Figure 2:
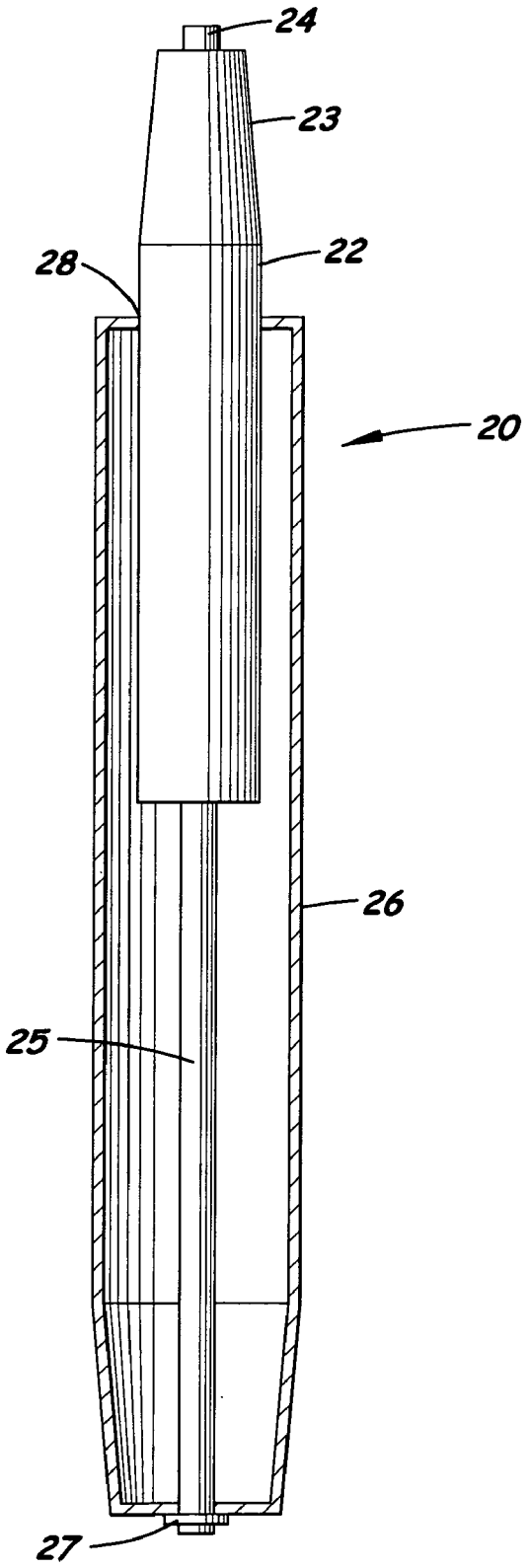
FIG. 2 is a partial cross section view of a gas spring and stand tube assembly used in the invention as a height adjustable column.

FIG. 2 shows in partial cross section a typical height adjustment column 20 which is usable within the invention. This height adjustment column 20 is a commercially available gas spring and stand tube assembly.

In general, the telescoping spring height adjustment lifting mechanism of the height adjustable column 20 comprises a first telescoping section 22, a second telescoping section 25, a resilient spring (compressed gas) disposed within the telescoping spring height adjustment lifting mechanism, and a movable actuation button disposed on the lockable telescoping spring height adjustment lifting mechanism. The actuation button, when moved, unlocks the lockable telescoping spring height adjustment lifting mechanism allowing relative movement between the first and second telescoping sections.

Specifically, the locking telescoping spring height adjustment lifting mechanism comprises a gas spring which comprises: a cylinder 22, a piston 25 disposed within the cylinder and extending therefrom to a secured position opposite the cylinder in the height adjustable column, a spring comprising pressurized gas disposed within the cylinder, and an actuation button 24 comprising a gas flow control valve extension actuation button that extends outwardly from the gas spring. The actuation button 24 extends upwardly from a tapered upper portion 23 of the cylinder 22.

The height adjustable column 20 also includes a stand tube 26. The telescoping spring height adjustment lifting mechanism is supported by the stand tube. The telescoping spring height adjustment lifting mechanism includes a portion of the cylinder which extends between the stand tube and the table top support. Downward forces applied to the table top will typically be transferred directly through the telescoping spring height adjustment lifting mechanisms.

Figure 3:
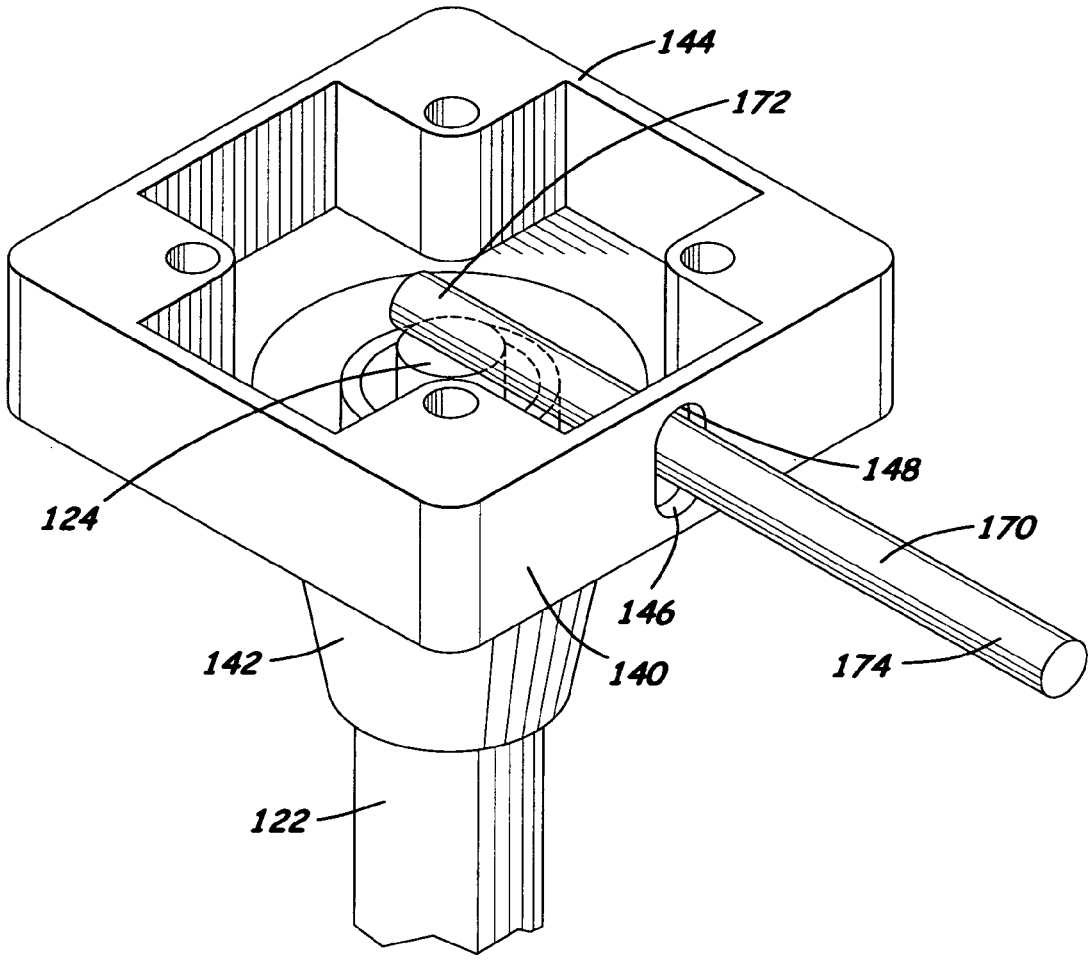
FIG. 3 is a perspective view showing a furniture component support and a height adjustment lever.

FIG. 3 shows a slightly modified version of the table top support 140. This slightly modified version of the table top support 140 differs from the previous table top support 40 only by the exclusion of a top panel. The table top support 140 includes a bottom socket 142, a top surface 144 for the support of a table top, an access opening 146 which includes a top surface 148. The top portion of a lockable telescoping spring height adjustment lifting mechanism 122 is shown disposed within the socket. An actuation button 124 is shown extending from the top of the lockable telescoping spring height adjustment lifting mechanism 122 into the interior of the table top support. The actuation mechanism for engaging and moving the actuation button of the lockable telescoping spring height adjustment lifting mechanism is a first height adjustment lever 170. The height adjustment lever 170 includes a first portion 172 which extends to the actuation button 124. The height adjustment lever 170 is supported by the table top support 140. The height adjustment lever 170 includes a second 174 which extends outwardly from the table top support and which is accessible to the table user. The height adjustment lever 170 in this version pivots about the top surface 148 of the access opening 146. As the height adjustment lever 170 pivots about the top surface 148 of the access opening 146, the first portion of the lever 172 depresses the actuation button moving the button from the locked to the unlocked position. This unlocking of the telescoping spring height adjustment lifting mechanism is also referred to as the actuation of the telescoping spring height adjustment lifting mechanism.

Figure 4:
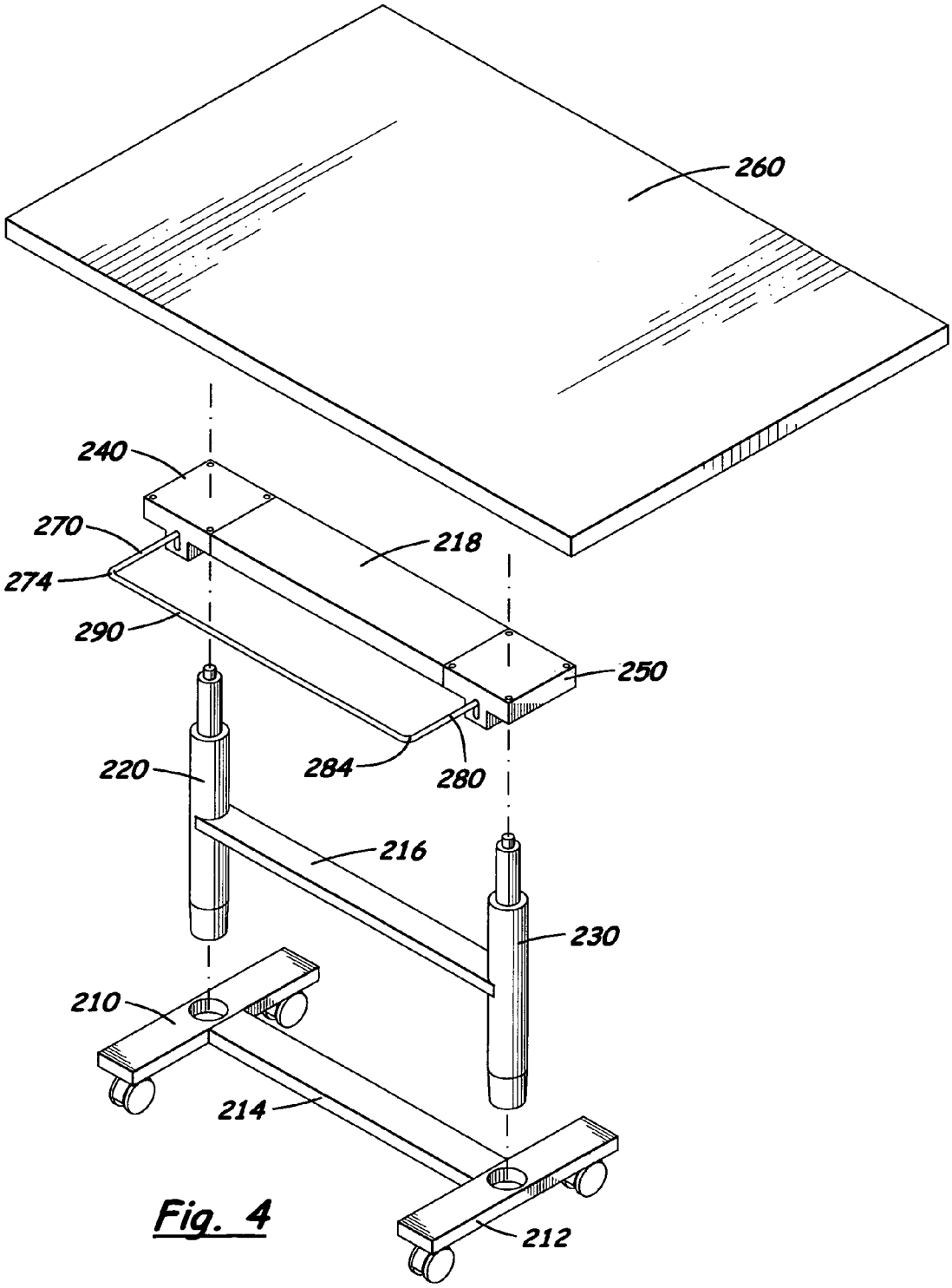
FIG. 4 is an exploded perspective view of a version of the invention.

FIG. 4 shows a modified version of the height adjustable table of FIG. 1. In this version a connecting bar 290 is shown connecting the second portions 274 and 284 of the first and second height adjustment levers 270 and 280. The connecting bar is movable vertically from a first position where the first portions of the height adjustment levers do not move the actuation buttons to a second position where the first ends of the height adjustment levers do move the actuation buttons. The connecting bar ensures that both of the height adjustment levers will actuate their respective telescoping spring mechanisms at the same time. The connecting bar also allows a single hand to actuate the telescoping spring mechanisms.

This version of the invention includes a connecting base section 214 which connects the first and second base section 210 and 212, a connecting support element 216 which extends between the first and second height adjustable columns 220 and 230, and a table top support connecting section 218 which connects the first and second table top support sections 240 and 250.

Figure 5A:
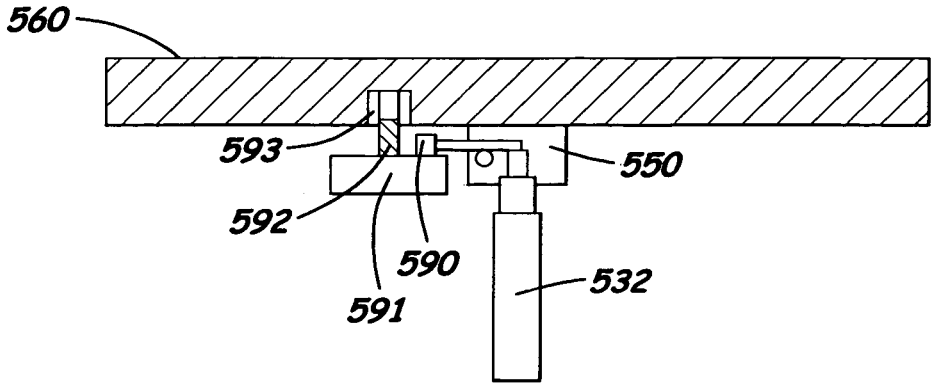
FIG. 5A is a first side view of a version of the invention which includes a prop.
Figure 5B:
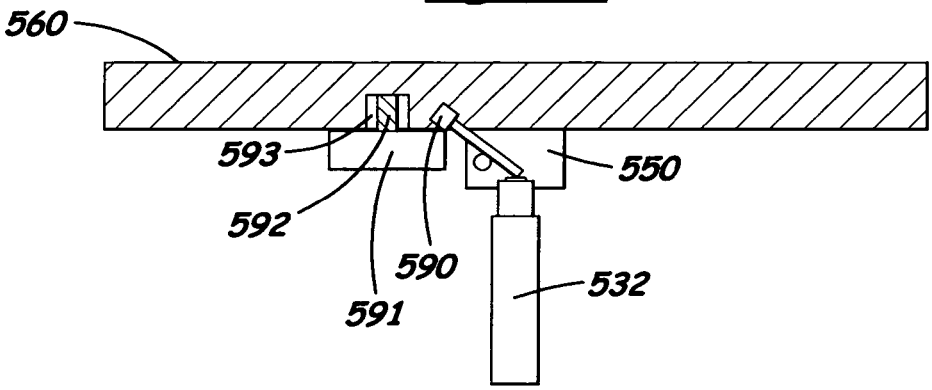
FIG. 5B is a second side view of a version of the invention which includes a prop.
Figure 5C:
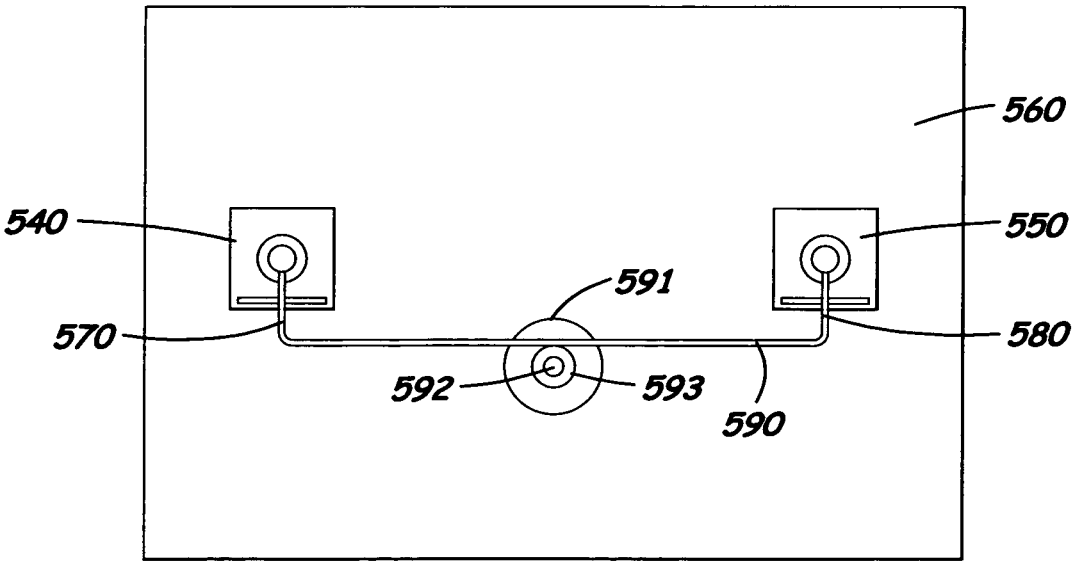
FIG. 5C is a top view of the version of the invention shown in FIGS. 5A and 5B.

The height adjustable table may further include means for supporting the connecting bar in the second position. A first version of this concept is shown in FIGS. 5A through 5C which show a prop for engaging the connecting bar and moving the connecting bar vertically upward. In FIGS. 5A and 5B, the table top 560 and the table top support 550 are shown in cross section to show the actuation mechanism.

In this version, the prop is a knob 591 which includes a threaded stem 592. The threaded stem of the knob threads into a threaded insert 593 within the table top 560. In this way, the knob is rotationally mounted to the height adjustable table. As the knob is threaded into the insert, the knob moves both vertically in relation to the connecting bar 590 and rotationally about the vertical axis of the threaded stem. The connecting bar 590 connects the first height adjustment lever 570 to the second height adjustment lever 580. The knob 591 moves from a first vertical position where the connecting bar is not moved, to a second vertical position where the connecting bar is engaged and moved. In use, the knob can be threaded into the insert until the connecting bar has moved vertically enough to cause the height adjustment levers to actuate both telescoping spring mechanisms 522 and 532. At this point, the user can allow the telescoping spring mechanisms to lift the table top, and assist the telescoping spring mechanisms in lifting the table top if necessary. Alternatively, the user can lower the table top by applying a downward force on the table top. Upon reaching the desired table top height, the user can unthread the knob partially from the insert, locking the table top at the new height.

FIG. 5C is a top view that shows the relative position of the knob on the table top. The table top is shown as thought it were transparent for the purpose of properly showing the actuation mechanism.

Figure 6A:
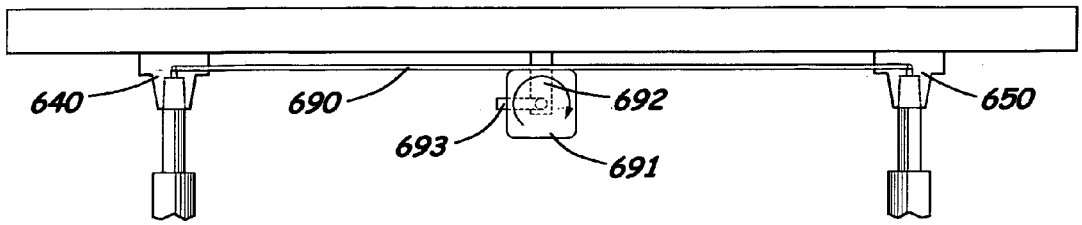
FIG. 6A is a first side view of a version of the invention which includes a second version of a prop.
Figure 6B:
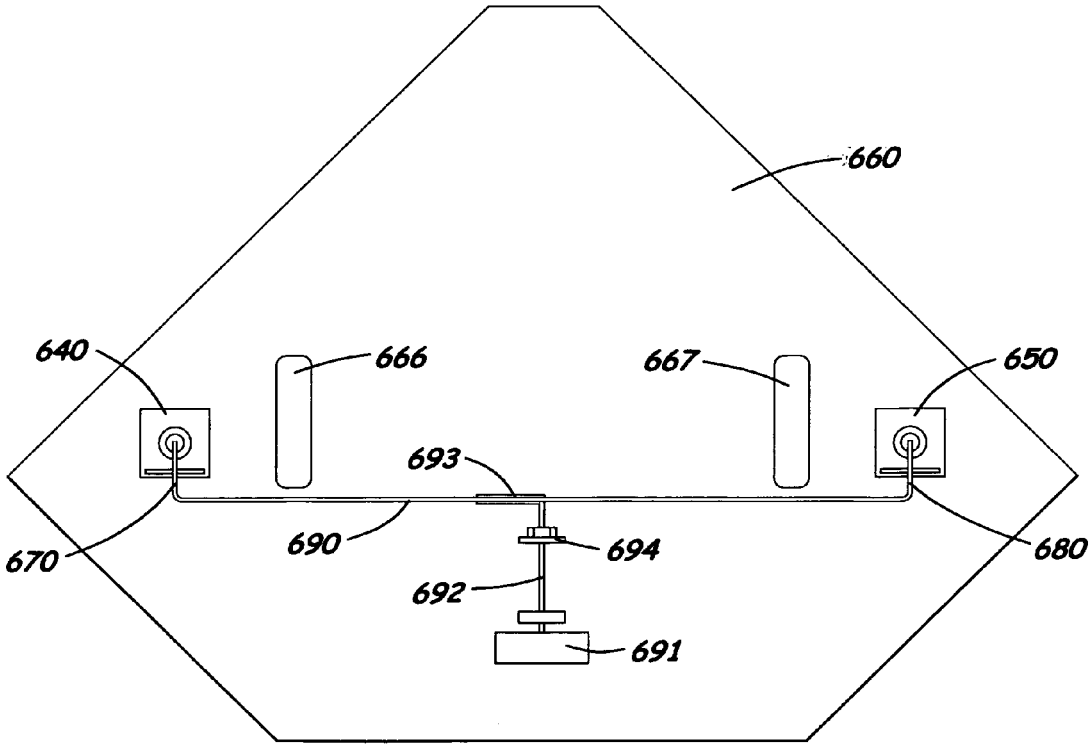
FIG. 6B is a top view of the version of the invention shown in FIG. 6A.

FIGS. 6A and 6B show another version of a prop for engaging and moving the connecting bar. In FIG. 6A a side view, a table top supports 640 and 650 are shown in cross-section to show the actuation mechanism. In FIG. 6B, a top view, the table top is again shown as though it were transparent. In this version, the connecting bar 690 connects the first and second height adjustment levers 670 and 680. The prop includes a knob 691, a stem 692, extending from the knob 691, a tab 693 for engaging and moving the connecting bar, and a bracket 694 which supports the prop, and attaches the prop to the table top 660. The knob rotates in a horizontal plane. As the knob rotates, the rotation is transferred to the tab 693 through the stem 692. The tab lifts the connecting bar which lifts the connected height adjustment levers 670 and 680.

FIG. 6B also shows the inclusion of a first slot 666 extending through the table top proximate to the first table top support 640, and a second slot 667 extending through the table top proximate to the second table top support 650. The slots are used by the table user to assist in the lifting of the table top if necessary. The connecting bar is disposed beneath the slots and may be accessed through the slots, if desired.

Figure 6C:
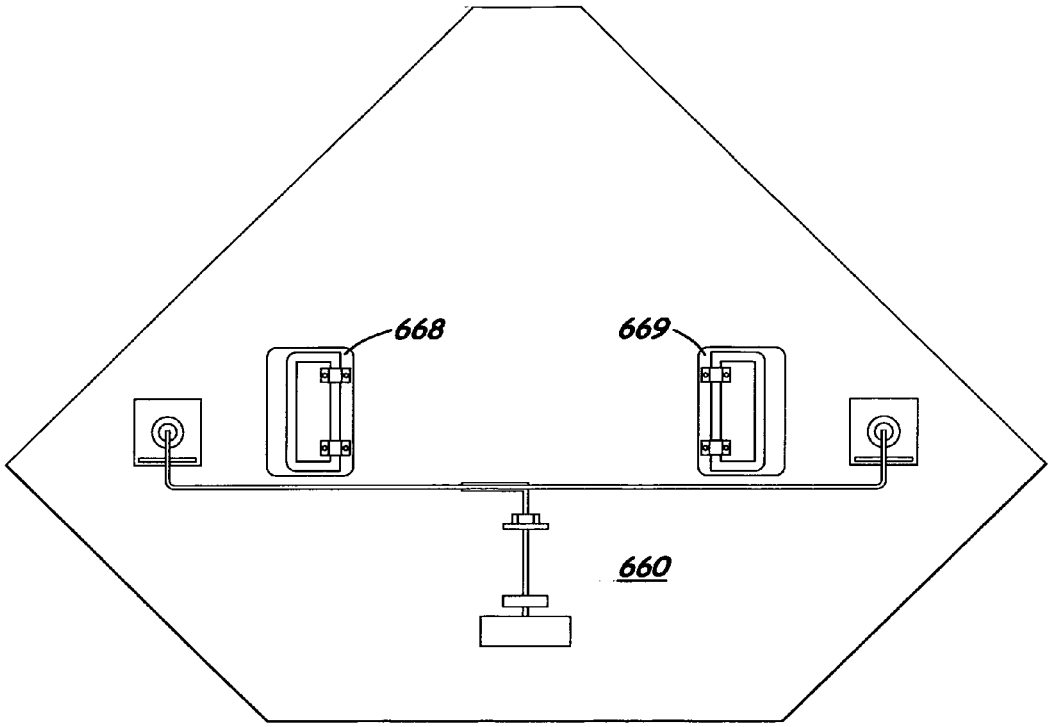
FIG. 6C is a first side view of a version of the invention which includes a third version of a prop.
Figure 6D:
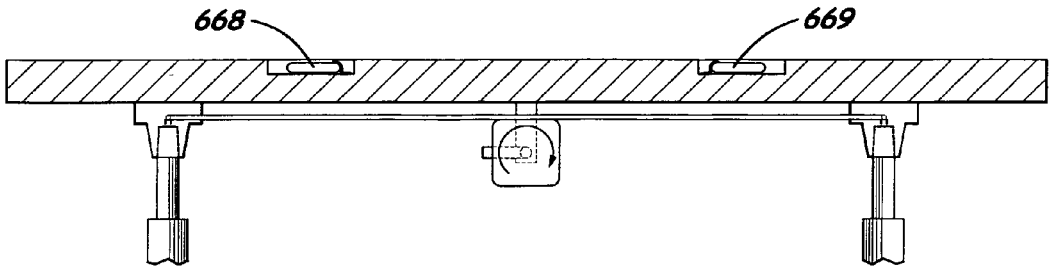
FIG. 6D is a top view of the version of the invention shown in FIG. 6A.

FIG. 6C shows the table top 660 further including a first handle 668 attached to the top surface of the table top proximate to the first table top support, and a second handle 669 attached to the top surface of the table top proximate to the second table top support. FIG. 6D shows how the handles can be disposed within recesses within the table top. Handles 668 and 669 are used by the table user to assist in the lifting of the table top, if necessary.

Figure 7:
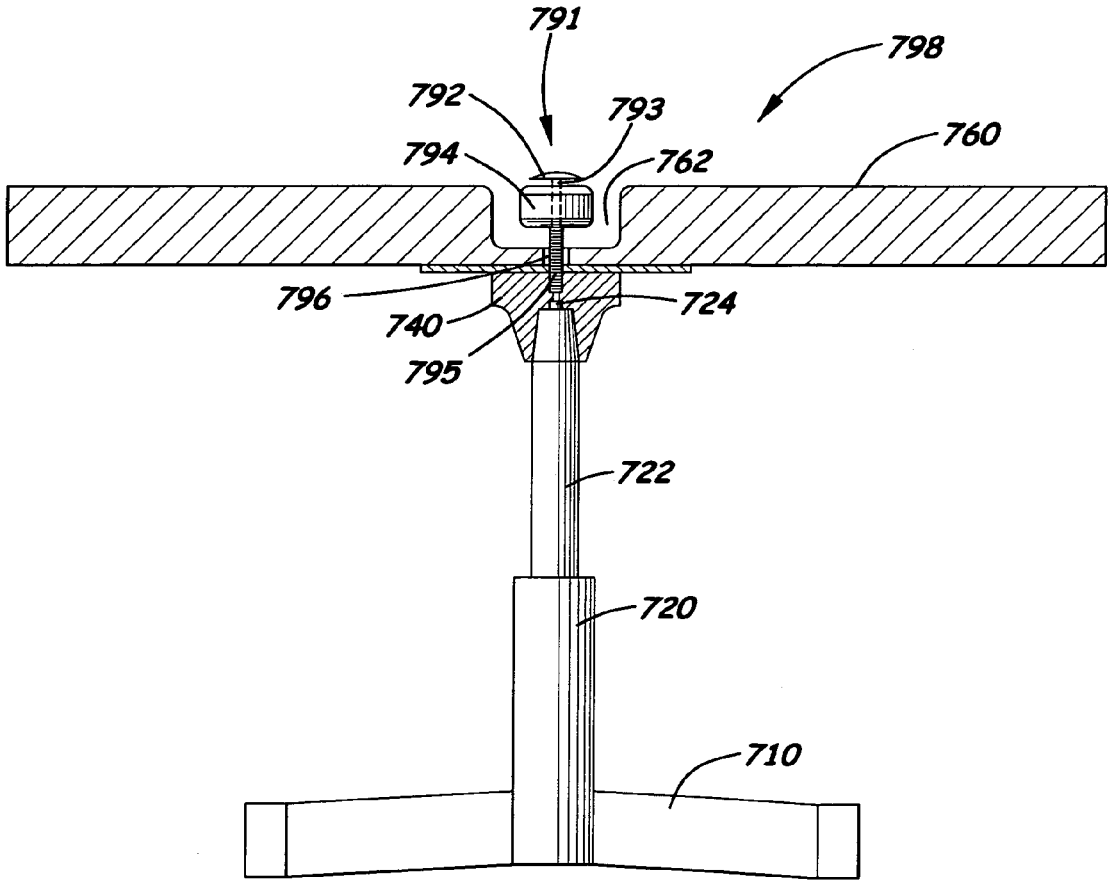
FIG. 7 is a side view of a version of the invention showing an actuation mechanism which extends above the top surface of the table top.

FIG. 7 shows a height adjustable table which comprises: a floor contacting base 710, a height adjustable column 720 disposed vertically above the base and supported by the base. The height adjustable column 720 comprises a telescoping spring height adjustment lifting mechanism 722. A table top support 740 is disposed vertically above the height adjustable column 720 and supported by the height adjustable column. The table top support is shown in cross section to reveal the operation of the actuation mechanism. A table top 760, also shown in cross section, is disposed vertically above the table top support 740 and is supported by the table top support.

The telescoping spring height adjustment lifting mechanism includes a resilient spring material. The telescoping spring height adjustment lifting mechanism is lockable and includes a movable actuation button 724. The movable actuation button is selectively movable from a first locked position to a second unlocked position. The lockable telescoping spring height adjustment lifting mechanism must be actuated to adjust the height of the table top relative to the floor.

The height adjustable table includes an actuation mechanism 791 which is supported by the height adjustable table for engaging and moving the actuation button of the lockable telescoping spring height adjustment lifting mechanism to the second unlocked position. The actuation mechanism is vertically disposed above the actuation button and includes a section which extends vertically above the top surface of the table top. In this version the table top includes a recess 762 within which the actuation mechanism is disposed. The top surface of the table top within the recess is at a lower vertical position relative to the remainder of the table top.

Upon the actuation of the lockable telescoping spring height adjustment lifting mechanism, the resilient spring material of the telescoping spring height adjustment lifting mechanism may be compressed. Also upon actuation, the resilient spring material of the telescoping spring height adjustment lifting mechanism, if compressed, will resiliently expand unless a sufficient compressive force is applied to the telescoping spring height adjustment lifting mechanism. The actuation and resilient expansion of compressed spring material the telescoping spring height adjustment lifting mechanism results in an upward force applied to the table top causing the rising of the table top.

The actuation mechanism includes a hand contact surface 792 which extends vertically above the top surface of the table top. The actuation mechanism further includes a vertically disposed stem 793 extending downwardly from the hand contact surface. The stem includes a bottom surface for contacting the actuation button of the lockable telescoping spring height adjustment lifting mechanism. The hand contact surface when depressed results in the bottom surface of the stem depressing the actuation button 724.

The height adjustable table, as shown, further includes a knob 793 disposed proximate to the hand contact surface of the actuation mechanism. In this version, the knob further includes a vertical conduit, and wherein the vertical stem of the actuation mechanism extends through the vertical conduit of the knob.

Additionally, the knob 794 includes a downwardly extending knob stem 795. The knob stem includes external threads. The knob stems are attached to the height adjustable table through internal threads 796 in the height adjustable table 798. The knob stem is disposed above the actuation button 724. The knob when threaded downwardly depresses the actuation button.

Accordingly, the actuation mechanism of FIG. 7 is operable in different ways. The hand contact surface 792 can be depressed which actuates the telescoping spring mechanism. Or the knob can be threaded downward until the stem of the knob, which is also disposed above the actuation button, engages and depresses the actuation button. Additionally, the knob can be grasped by the user to pull up on the table top to assist the lifting of the table top once the telescoping spring mechanisms has been actuated in either of the two ways.

The height adjustable table includes a threaded insert 796 which supports the knob stem and thus the entire actuation mechanism. This threaded insert may be disposed within the table top which results in the table top supporting the actuation mechanism. Alternatively, the threaded insert can be attached to the top of the table top support 740, wherein the actuation mechanism is supported by the table top support. Again, the threaded insert is shown in FIG. 7 at a position where the threaded insert could be supported either by the table top or the table top support.

Figure 8A:
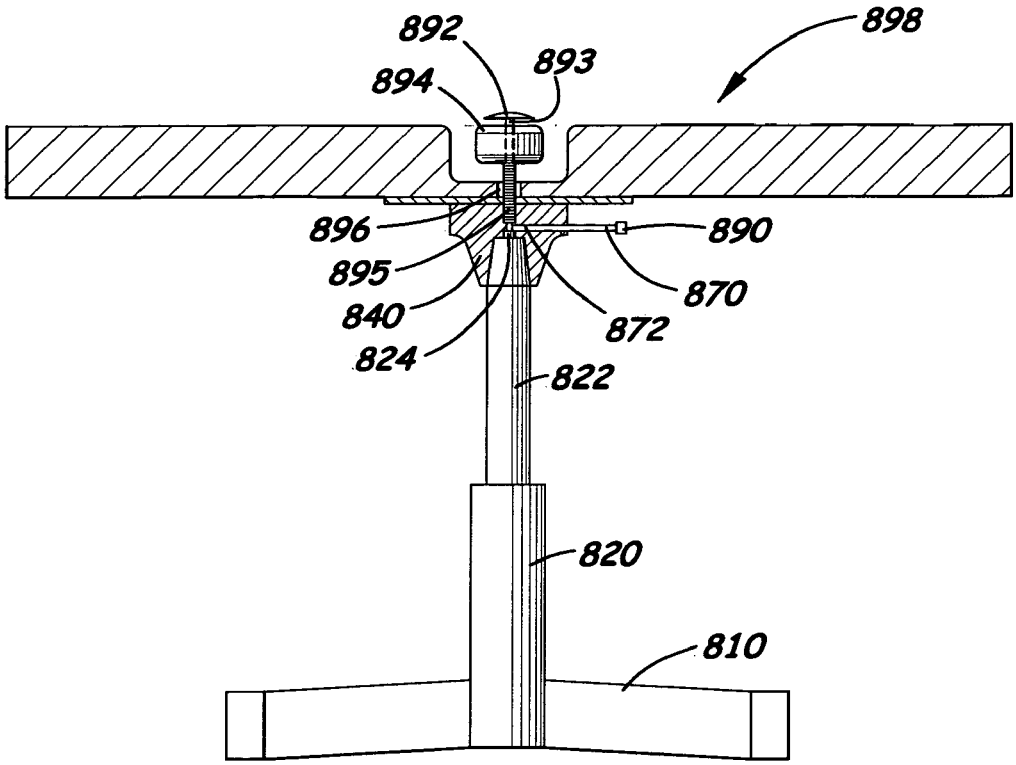
FIG. 8A is a side view of a modified version of the invention of FIG. 7 showing an actuation mechanism which extends above the top surface of the table top.
Figure 8B:
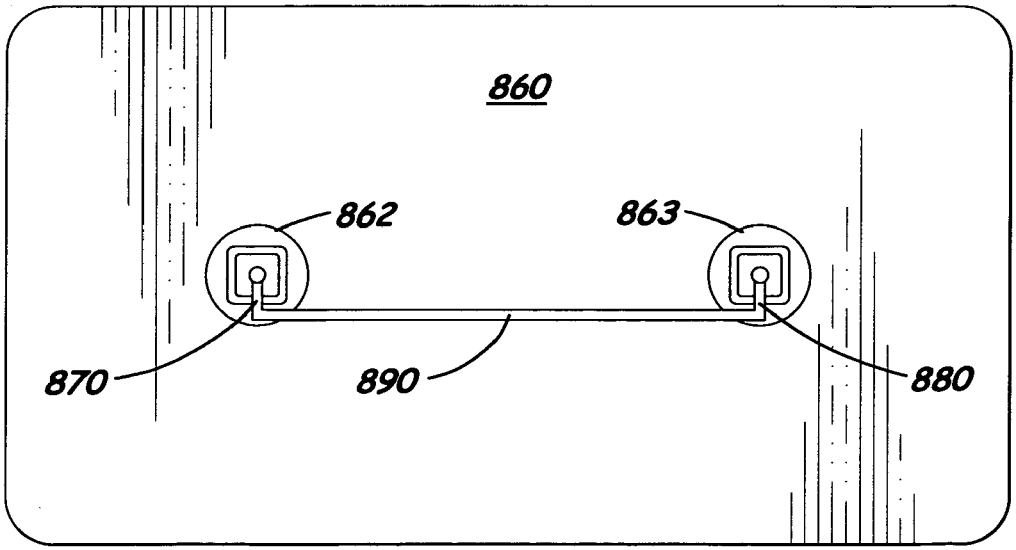
FIG. 8B is a top view of the version of the invention shown in FIG. 8A.

FIGS. 8A and 8B show a height adjustable table where the table includes two height adjustable columns, and the actuation mechanism of FIG. 7 has been used above each of the two height adjustable columns. The actuation mechanism further includes the use of two height adjustment levers 870 and 880, and a connecting bar 890.

FIG. 8A is a side view which shows one side of the table. FIG. 8A shows a first base section 810, a height adjustable column 820 disposed vertically above the base and supported by the base section. The height adjustable column 820 comprises a telescoping spring height adjustment lifting mechanism 822. A table top support 840 is disposed vertically above the height adjustable column 820 and supported by the height adjustable column. The table top support is shown in cross section to reveal the operation of the actuation mechanism. A table top 860 is disposed vertically above the table top support 840 and is supported by the table top support.

The telescoping spring height adjustment lifting mechanism includes a resilient spring material. The telescoping spring height adjustment lifting mechanism is lockable and includes a movable actuation button 824. The movable actuation button is selectively movable from a first locked position to a second unlocked position. The lockable telescoping spring height adjustment lifting mechanism must be actuated to adjust the height of the table top relative to the floor.

The height adjustable table includes an actuation mechanism is supported by the height adjustable table for engaging and moving the actuation button of the lockable telescoping spring height adjustment lifting mechanisms to the second unlocked position. The actuation mechanism is vertically disposed above the actuation buttons and includes a section which extends vertically above the top surface of the table top. In this version the table top includes recesses 862 (and 863) within which the actuation mechanism is disposed. The top surface of the table top within the recess is at a lower vertical position relative to the remainder of the table top.

Upon the actuation of the lockable telescoping spring height adjustment lifting mechanisms, the resilient spring material of the telescoping spring height adjustment lifting mechanisms may be compressed. Also upon actuation, the resilient spring material of the telescoping spring height adjustment lifting mechanisms, if compressed, will resiliently expand unless a sufficient compressive force is applied to the telescoping spring height adjustment lifting mechanisms. The actuation and resilient expansion of compressed spring material the telescoping spring height adjustment lifting mechanisms results in an upward force applied to the table top causing the rising of the table top.

The actuation mechanism includes a first section which is shown in FIG. 8A for actuation the telescoping spring mechanism 822 in FIG. 8A. FIG. 8B show the second section for actuation of the second telescoping spring mechanism, and the third section which comprises the connecting bar 890. In this version, the first and second sections are identical and for this reason, only the first section is shown in entirety.

Returning to FIG. 8A, the actuation mechanism first section includes a hand contact surface 892 which extends vertically above the top surface of the table top. The actuation mechanism further includes a vertically disposed stem 893 extending downwardly from the hand contact surface. The stem includes a bottom surface for contacting the actuation button of the lockable telescoping spring height adjustment lifting mechanism. The hand contact surface when depressed results in the bottom surface of the stem depressing the actuation button 824.

The actuation mechanism first section, as shown, further includes a knob 894 disposed proximate to the hand contact surface of the actuation mechanism. In this version, the knob further includes a vertical conduit, and wherein the vertical stem of the actuation mechanism extends through the vertical conduit of the knob.

Additionally, the knob includes a downwardly extending knob stem 895. The knob stem includes external threads. The knob stems are attached to the height adjustable table through internal threads 896 in the height adjustable table 898. The knob stem is disposed above the actuation button 824. The knob when threaded downwardly depresses the actuation button.

Accordingly, the actuation mechanism of FIG. 8A is operable in different ways. The hand contact surface 892 can be depressed which actuates the telescoping spring mechanism. Or the knob can be threaded downward until the stem of the knob, which is also disposed above the actuation button, engages and depresses the actuation button. Additionally, the knob can be grasped by the user to pull up on the table top to assist the lifting of the table top once the telescoping spring mechanisms has been actuated in either of the two ways.

The height adjustable table includes a threaded insert 896 which supports the knob stem and thus the entire actuation mechanism. This threaded insert may be disposed within the table top which results in the table top supporting the actuation mechanism. Alternatively, the threaded insert can be attached to the top of the table top support 840, wherein the actuation mechanism is supported by the table top support. Again, the threaded insert is shown in FIG. 8A at a position where the threaded insert could be supported either by the table top or the table top support.

In this version of the invention, the first section of the actuation mechanism further includes a height adjustment lever 870 which pivots in the manner described in FIGS. 1 through 4. The height adjustment lever 870 includes a first portion 872 which is disposed above the actuation button 824. This first portion of the height adjustment lever separates the actuation button 824 from the bottom surface of the hand contact surface stem 893, and the knob stem 895. Accordingly, the hand contact surface 892 when depressed actually results in the bottom surface of the hand contact surface stem 893 depressing the actuation button 824 through the first portion 872 of the height adjustment lever. Similarly, the knob stem 895 if threaded downward, will depress the actuation button through contact with the first portion 872 of the height adjustment lever 870.

The connecting bar 890 is used to ensure that the actuation of both telescoping spring mechanism occurs at substantially the same time. The connecting bar transfers the movement of one height adjustment lever to the opposite lever. This allows the user to use only one section of the actuation mechanism if desired. Alternatively, the height adjustable table could forego the use of the connecting bar and the height adjustment levers and operate in the manner as was described for FIG. 7. In this instance, both locking telescoping spring height adjustment mechanisms would need to be individually actuated for a height adjustment to be made.

FIG. 8B shows the relative positions of the first, second and third actuation mechanism sections. FIG. 8B is a top view and is as if the table top were transparent.

The hand contact surfaces and knobs or the actuation mechanism which are shown directly above the actuation buttons may alternatively be disposed above the height adjustment levers at a position on either side of the actuation button.

Figure 9:
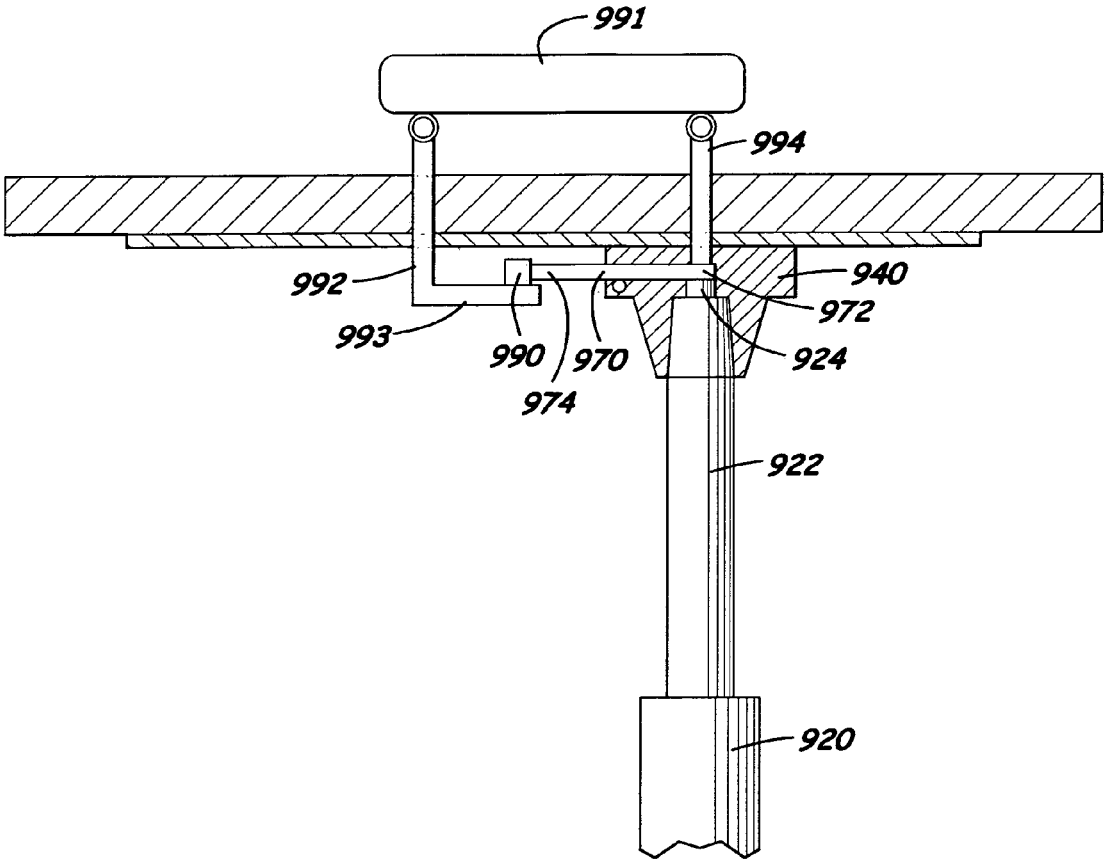
FIG. 9 is a side view of another version of the invention showing an actuation mechanism which extends above the top surface of the table top.

FIG. 9 shows a side view of an actuation mechanism that like the actuation mechanism of FIGS. 7 and 8 extends vertically above the top surface of the table top.

Like the versions of the invention shown in FIGS. 7 and 8, this version of the invention is usable to actuate a single telescoping spring mechanism as was shown in FIG. 7 or can be used on a height adjustable table having two, or more, height adjustable columns as was shown in FIG. 8. If the actuation mechanism is used to actuate two telescoping spring mechanisms, an actuation mechanism second section which is identical to the actuation mechanism first section which is shown in FIG. 9 would be additionally be used. Additionally, a connecting bar would also be used. A connecting bar 990 is shown in FIG. 9.

The actuation mechanism first section which is shown in FIG. 9 includes a height adjustment lever 970 which includes a first portion 972 disposed above the actuation button 924, and a second portion 974. The height adjustment lever works in the identical manner as has been previously been described. A first stem 992 is disposed adjacent to the second portion of the first height adjustment lever. The first stem extends vertically to a position above the table top, where the first stem is attached to a first hand contact surface or handle. The first stem 992 of the actuation mechanism first section includes an extension 993 which is a means to engage and move the second ends of the first and second height adjustment levers.

The first hand contact surface further includes a second stem 994 extending downwardly through the table top. The second stems extend downward from the hand contact surfaces to a position vertically above the actuation button 924.

The hand contact surface 991 or handle is able to be pushed downwardly which results in the second stem depressing the actuation button through the first portion of the actuation lever 972. The hand contact surface can alternatively be lifted, which results in the first stem engaging and moving the second portion of the height adjustment lever 974.

Again, FIG. 9 shows on actuation mechanism section. An identical second section can be used with a second height adjustment column in the manner described in FIG. 8. Accordingly, the actuation mechanism second section includes a first stem disposed adjacent to the second portion of the second height adjustment lever. The first stem of the second height adjustment lever extends vertically to a position above the table top. A second hand contact surface attached to the first stem at the position above the table top. The second hand contact surface further includes a second stem extending downwardly through the table top.

The height adjustable table if using two height adjustable columns would further comprising a connecting bar 990 connecting the second portions of the first and second height adjustment levers. The connecting bar is movable from a first position where the first portions of the height adjustment levers do not move the actuation buttons, to a second position where the first portions of the height adjustment levers do move the actuation buttons. Here again, the connecting bar transfers the movement at the hand contact surface to the actuation mechanism section disposed on the other height adjustable column of the table. This allows for single hand actuation if desired. It also ensures that if one telescoping spring mechanism is actuated, then the other telescoping spring mechanism will also be actuated.

Figure 10A:
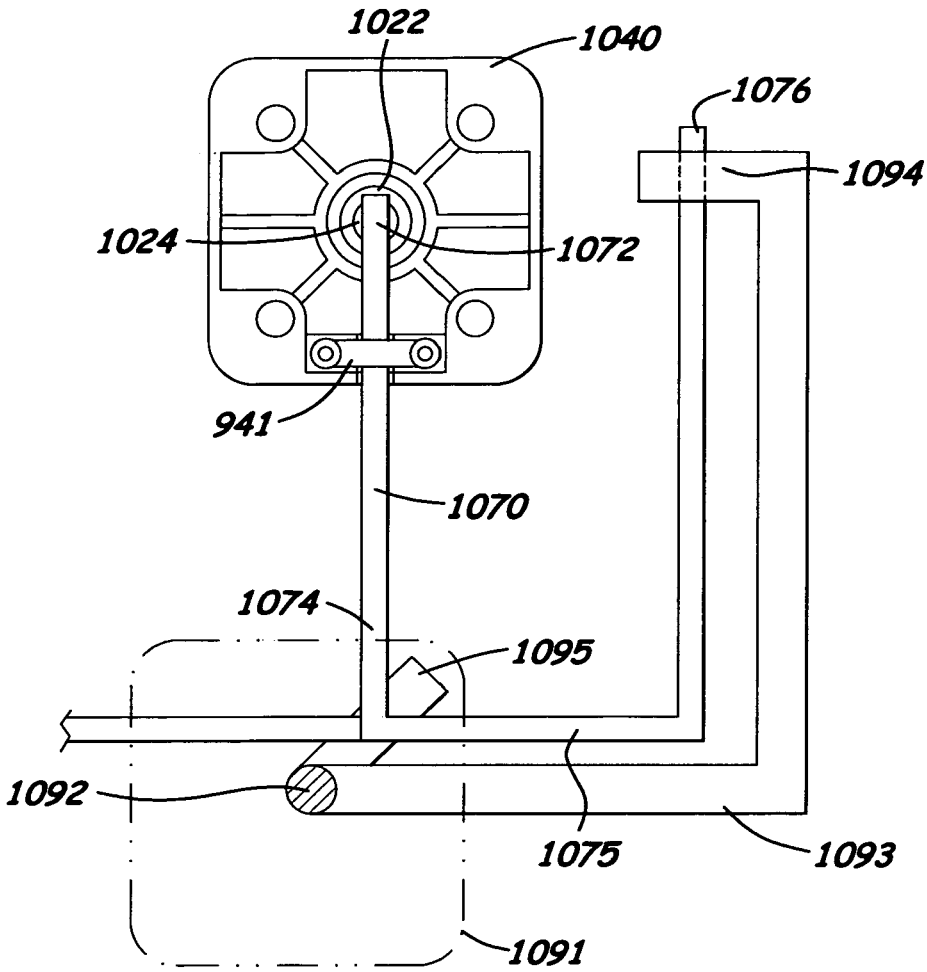
FIG. 10A is a top view of another version of the invention showing an actuation mechanism which extends above the top surface of the table top.

FIG. 10A shows another actuation mechanism. In this figure, like the previously described FIG. 9, only the first section of the mechanism is shown. FIG. 10C which follows shows the first section again along with the second and third sections. Like the previous version of FIGS. 7, 8, and 9 the actuation mechanism shown in FIG. 10 would be usable alone to actuate the telescoping spring mechanism in a height adjustable table which includes a single telescoping spring mechanism.

Figure 10B:
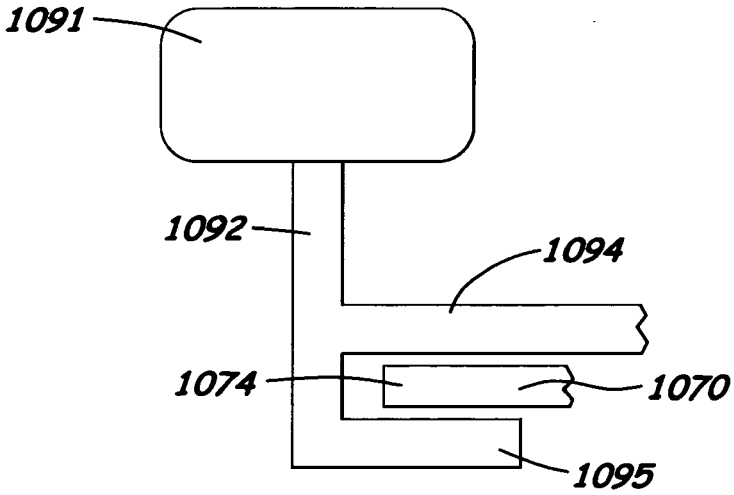
FIG. 10B is a side view of a portion of the actuation mechanism shown in FIG. 10A.
Figure 10C:
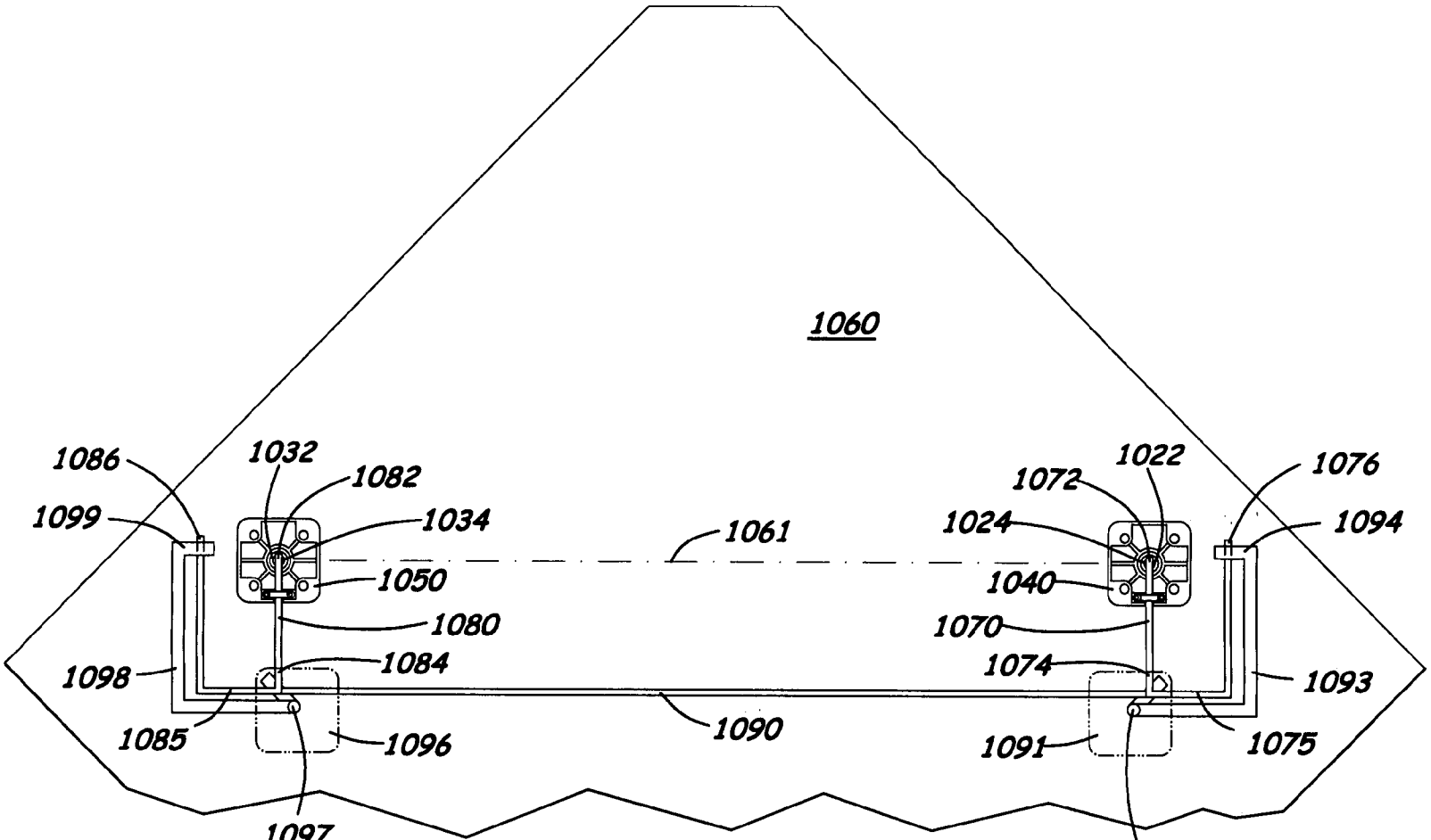
FIG. 10C is another top view of the version of the invention shown in FIG. 10A showing an actuation mechanism which extends above the top surface of the table top.

The actuation mechanism first section is shown in a top view in FIG. 10A and partially in a side view in FIG. 10B. The actuation mechanism first section includes a height adjustment lever 1070 which includes a first portion 1072 is disposed above the actuation button 1024 of the telescoping spring mechanism 1022, and a second portion 1074. The height adjustment lever 1070 works in the identical manner as has been previously been described. A stem 1092 is disposed adjacent to the second portion 1074 of the first height adjustment lever 1070. The stem 1092 extends vertically to a position above the table top, where the stem is attached to a first hand contact surface 1091 or handle. The outline of the hand contact surface 1091 is shown in dotted lines to show where its relative position is. The stem is shown in cross section. The stem 1092 of the actuation mechanism first section includes a stem portion 1095 which is disposed beneath the second portion 1074 of the height adjustment lever 1070. The stem portion 1095 is a means to engage and move the second of the first and second height adjustment levers in an upward direction. Accordingly, lifting upward on the hand contact surface 1091 results in the lifting upward of the second portion 1074 which will result in the depressing of the actuation button 1024 by the first portion 1072. The relative position of the stem portion 1095 and the second portion 1074 of the height adjustment lever 1070 are shown in FIG. 10B. In this figure, the height adjustment lever 1070 is only partially shown with the remaining portion broken away.

A line 1061 is shown connecting the actuation buttons in a the top view of FIG. 10C. In this view, the table top is again shown as though it were transparent so that the actuation mechanism can be shown. The outlines of the hand contact surfaces or handles are shown in dotted lines to show their respective positions.

FIG. 10C shows the actuation mechanism first section which was described in FIG. 10A, and which actuates the telescoping spring mechanism 1022. FIG. 10C also show the actuation mechanism second section which actuates the telescoping spring mechanism 1032, and the third section, which is the connecting bar 1090. The second actuation mechanism section is a mirror image of the first actuation mechanism section. Just as the first actuation mechanism includes a first height adjustment lever 1070, the second actuation mechanism includes a second height adjustment lever 1080. The first and second height adjustment levers are substantially parallel and extend away from the actuation buttons on one side of the line 1061 which connects the actuation buttons. The first and second height adjustment levers each include a lever extension 1075 and 1085 which extend from a first position proximate to the second portions of the levers 1074 and 1084 to a second position 1076 and 1086 disposed opposite the line which connects the actuation buttons. The stems of the first and second actuation mechanism sections 1092 and 1097 each include a stem extension 1093 and 1098 which extends from a first position where the stem extension is attached to the stem to a second position 1094 and 1099 disposed immediately above the second position of the lever extensions 1076 and 1086.

The downward movement of the stems 1092 and 1097 results in the downward movement of the stem extensions 1093 and 1098, and wherein the downward movement of the stem extensions 1093 and 1098 cause the second position of the stem extensions 1094 and 1099 to bear on the second position 1076 and 1086 of the lever extensions and move the second positions of the lever extensions downward. The downward movement of the second positions of the levers extension 1076 and 1086 cause the downward movement of the first portions of the height adjustment levers 1072 and 1082. This is because the lever extensions are rigidly attached to the height adjustment levers. The downward movement of the first portions of the height adjustment levers 1072 and 1082 actuates the locking telescoping spring height adjustment mechanism 1022 and 1032.

The actuation mechanism as shown in FIG. 10C also is shown including the optional connecting bar which transfers movements of one height adjustment lever to the other height adjustment lever. The connecting bar 1090 is movable from a first position where the first portions of the height adjustment levers do not move the actuation buttons, to a second position where the first portions of the height adjustment levers do move the actuation buttons.

Although somewhat complex, the actuation mechanism of FIG. 10A through 10C do allow a single hand contact surface (handle) to move upwardly or downwardly, with both movements resulting in the actuation of the telescoping spring mechanism. Although the height adjustable columns and base structure for the height adjustable table of FIGS. 10A through 10C has not been shown, it is understood that the structure is as has been previously described in previous versions of the invention.

Figure 11A:
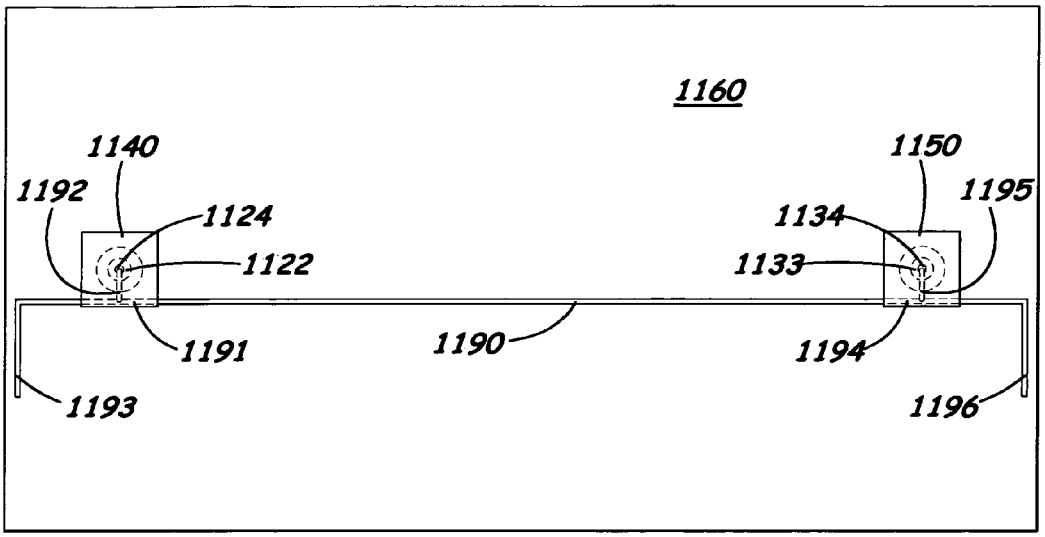
FIG. 11A is a top view of another version of the invention.
Figure 11B:
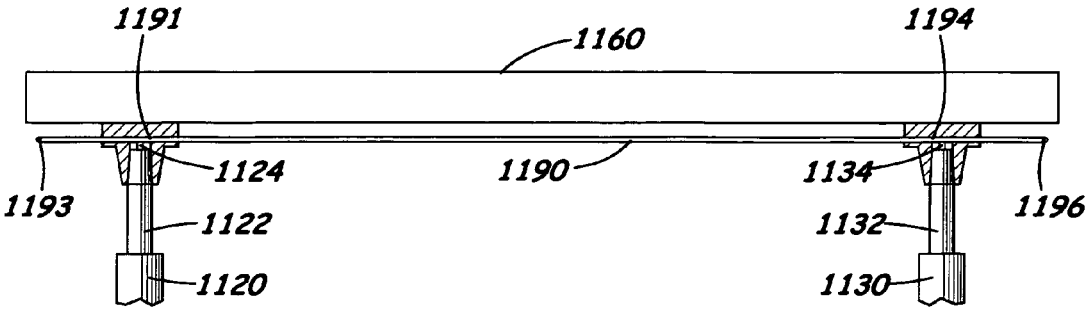
FIG. 11B is a side view of a version of the invention of FIG. 11A.

FIGS. 11A and 11B show another version of the height adjustable table. The floor contacting base including a first base section, and a second base section have been removed but would be as has been shown previously. The height adjustable table includes a first height adjustable column 1120 disposed vertically above the first base section and supported by the first base section, and a second height adjustable column 1130 disposed vertically above the second base section and supported by the second base section. The first height adjustable column includes a locking telescoping spring height adjustment lifting mechanism 1122. The second height adjustable column comprises a locking telescoping spring height adjustment lifting mechanism 1132. As has been previously described the locking telescoping spring height adjustment lifting mechanisms are typically gas springs.

A first table top support 1140 is disposed vertically above the first height adjustable column and is supported by the first height adjustable column. A second table top support 1150 is disposed vertically above the second height adjustable column and is supported by the second height adjustable column. A table top 1160 is disposed vertically above the table top supports and supported by the table top supports.

Each telescoping spring height adjustment lifting mechanism includes a resilient spring material. Each lockable telescoping spring height adjustment lifting mechanism includes a movable actuation button 1124 and 1134. The movable actuation button is selectively movable from a first locked position to a second unlocked position. Each lockable telescoping spring height adjustment lifting mechanism must be actuated to adjust the height of the table top relative to the floor.

The height adjustable table includes an actuation mechanism supported by the height adjustable table for engaging and moving the actuation button of each lockable telescoping spring height adjustment lifting mechanism to the second unlocked position. Upon the actuation of each lockable telescoping spring height adjustment lifting mechanism, the resilient spring material of each telescoping spring height adjustment lifting mechanism may be compressed. Also upon actuation, the resilient spring material of each telescoping spring height adjustment lifting mechanism, if compressed, will resiliently expand unless a sufficient compressive force is applied to the telescoping spring height adjustment lifting mechanisms.

The actuation mechanism includes a first rotationally mounted shaft 1191, and an eccentrically mounted cam 1192 disposed on the first rotationally mounted shaft. The eccentrically mounted cam 1192 is disposed at least partially above the actuation button 1124 of the first telescoping spring height adjustment lifting mechanism 1122. Rotation of the first rotationally mounted shaft 1191 results in the movement of the eccentrically mounted cam 1192 from a first position where the actuation button of the first telescoping spring height adjustment lifting mechanism is not moved, to a second position where the eccentrically mounted cam engages and moves the actuation button.

The actuation mechanism further includes a second rotationally mounted shaft 1194 and an eccentrically mounted cam 1195 disposed on the second rotationally mounted shaft. The eccentrically mounted cam is disposed at least partially above the actuation button 1134 of the second telescoping spring height adjustment lifting mechanism 1132. Rotation of the second rotationally mounted shaft 1194 results in the movement of the eccentrically mounted cam 1195 from a first position where the actuation button of the second telescoping spring height adjustment lifting mechanism is not moved, to a second position where the eccentrically mounted cam engages and moves the actuation button.

The actuation and resilient expansion of compressed spring material of each of the telescoping the spring height adjustment lifting mechanisms results in an upward force applied to the table top causing the rising of the table top. The first and second rotationally mounted shafts of the actuation mechanism are supported by the table top supports. The first and second rotationally mounted shafts of the actuation mechanism may include extensions such as the lever extensions 1193 and 1196. Alternatively knobs could have been attached to the rotationally mounted shafts. In either case, the lever extensions or knobs allow the table user to rotate the rotationally mounted shafts.

The actuation mechanism of the height adjustable table may further comprise a rotationally mounted connecting shaft 1190 which is co-axial with and attached to the first and second shafts. This connecting shaft transfers movement of one rotationally mounted shaft to the second rotationally mounted shaft. This ensures that both of the telescoping spring mechanisms are both actuated so that a height adjustment can be made.

Figure 11C:
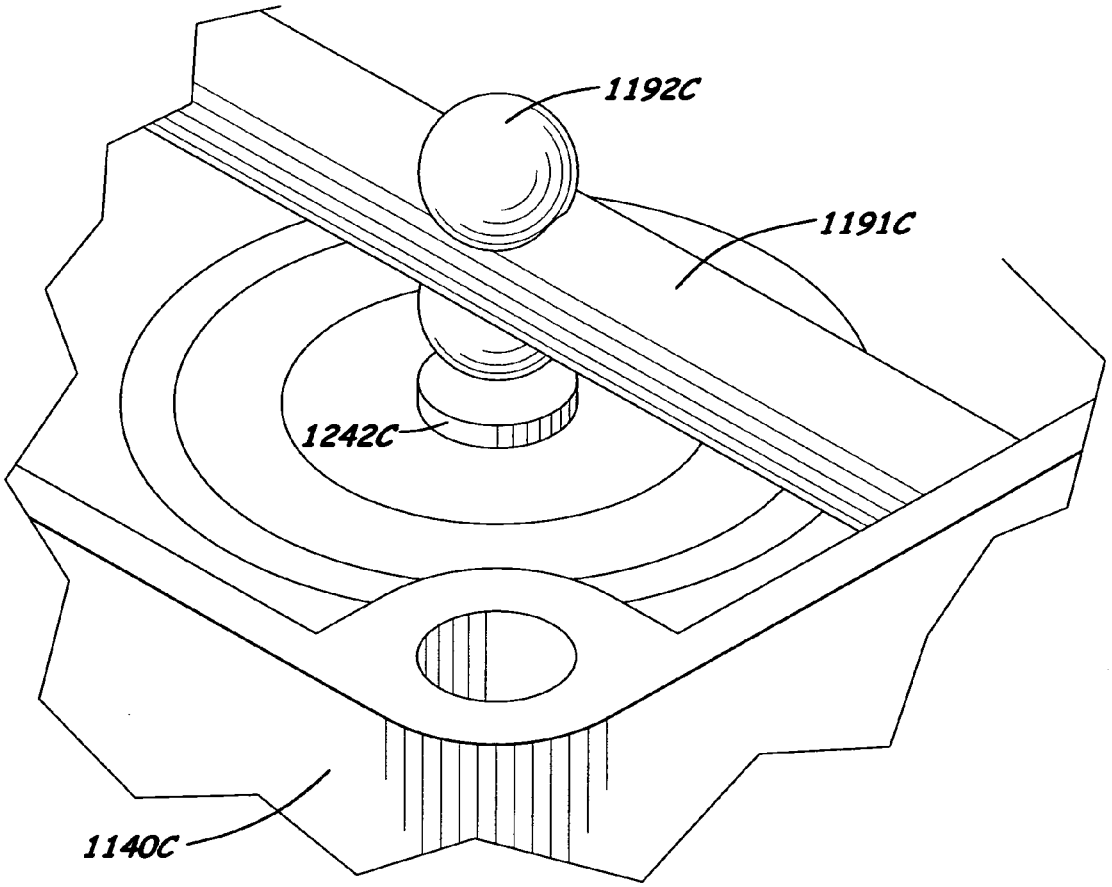
FIG. 11C is a top perspective view of a modified version of the actuation mechanism of the present invention of FIG. 11A.

FIG. 11C shows how the rotational shaft 1191C and the eccentrically mounted cam 1192C can be disposed immediately above the actuation button 1124C.

The telescoping spring height adjustment lifting mechanisms and the height adjustable columns used in the version of the invention of FIGS. 11A through 11C have been described in the description of previous versions of the invention.

Figure 12A:
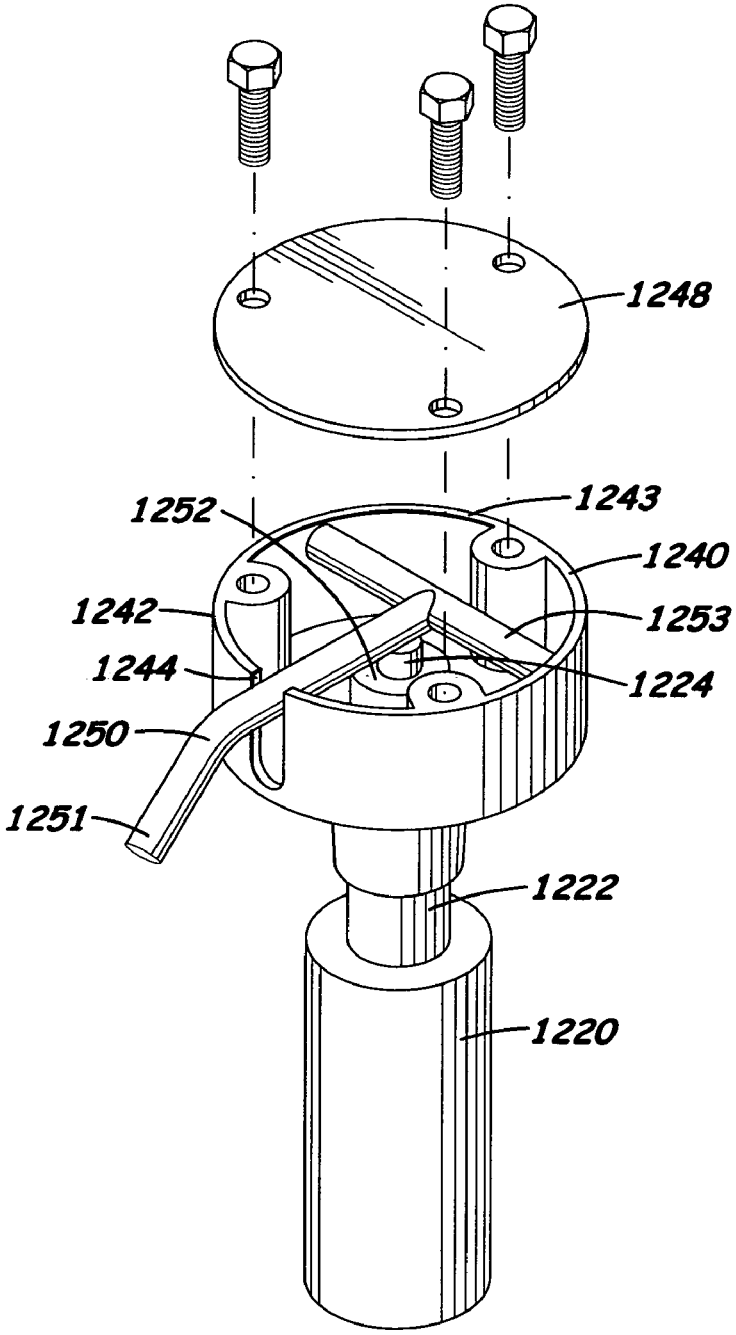
FIG. 12A is an exploded view of another version of the invention.
Figure 12B:
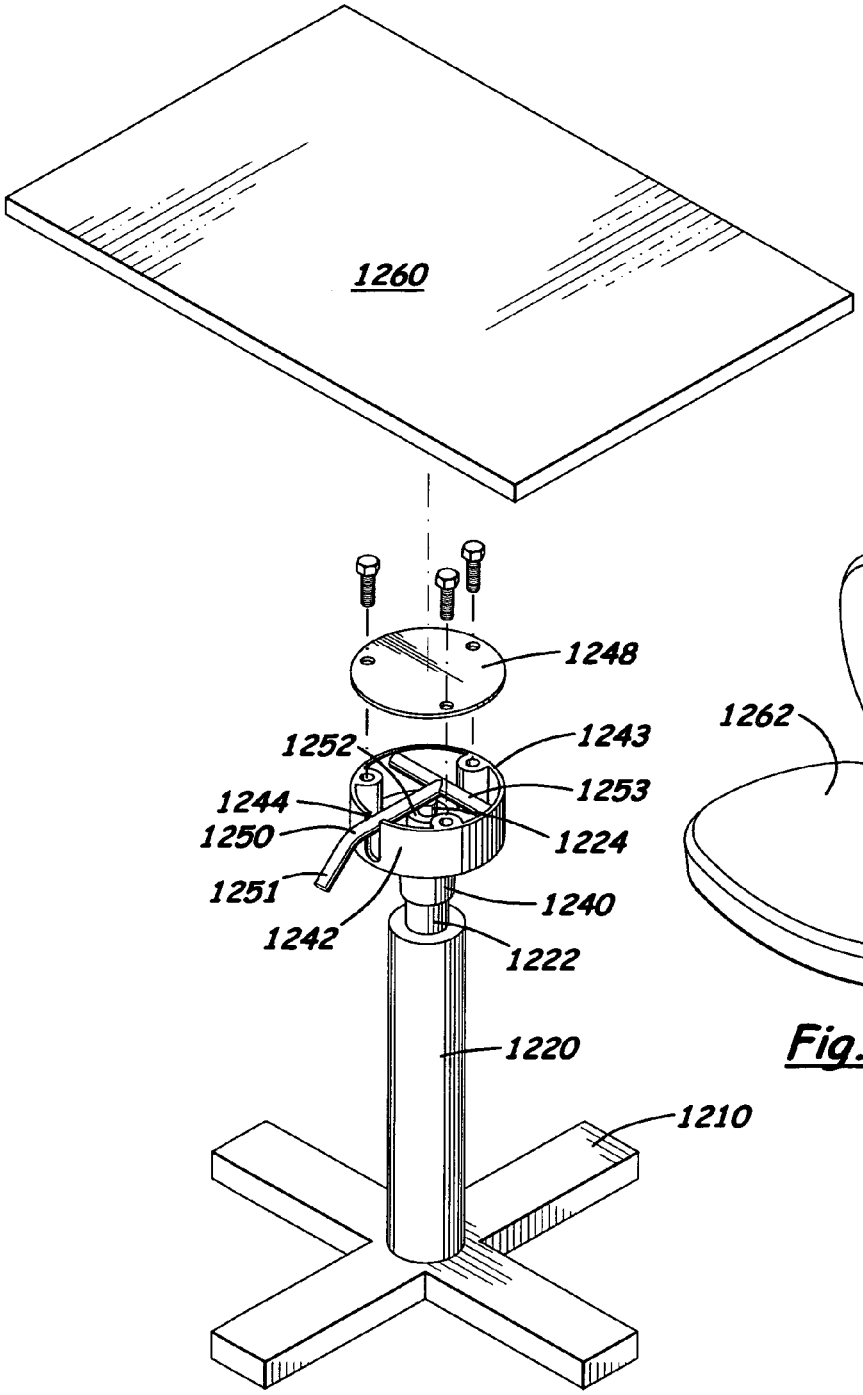
FIG. 12B is an exploded view of the version of the invention shown in FIG. 12A.

FIG. 12A shows a portion of a height adjustable column for furniture components. FIG. 12B shows the height adjustable column included within a height adjustable table that further includes a floor contacting base, and a table top supported above the height adjustable column.

The height adjustable column 1220 includes a locking telescoping spring height adjustment lifting mechanism 1222. The locking telescoping spring height adjustment lifting mechanism includes a valve actuation button 1224 that extends outwardly from the mechanism.

The height adjustable column includes at least first and second substantially upright opposing surfaces 1242 and 1243 which are in this instance part of a furniture component support mechanism. In this instance the furniture component support mechanism is a table top support mechanism. The first and second substantially upright opposing surfaces 1242 and 1243 are disposed at substantially the vertical position of the valve actuation button on the telescoping spring mechanism. The first and second substantially upright opposing surfaces each include an inside surface which faces the valve actuation button, and an outside surface facing away from the valve actuation button. The first upright surface includes a first enlarged opening 1244.

An actuation lever is disposed on the height adjustable column and includes a first handle section 1251 disposed outside the first substantially upright surface 1242. A second section 1252 is disposed between the first and second upright surfaces 1242 and 1243 and extends from the first opening 1244 of the first substantially upright surface 1242 to the actuation button 1224. A third actuation lever section 1253 extends from the actuation button opposite the second section. The third section includes a distal end disposed between the second substantially upright surface 1243 and the actuation button 1224. In this version, the first section 1251 of the actuation lever angles downwardly from the second section 1252.

A plate 1248 which is a horizontal panel is disposed above the table top support. A first fulcrum bearing surface is disposed above the first enlarged opening at a position above the actuation lever. This first fulcrum bearing surface is provided by the bottom surface of the plate 1249. A second fulcrum bearing surface is disposed at a position above the distal end of the third section of the actuation lever. This second fulcrum surface is also provided by the bottom surface of the plate. The fulcrum bearing surfaces provide a surface on which the lever may pivot.

The second section 1252 of the actuation lever is disposed adjacent to the valve actuation button 1224. Pivoting of the actuation lever on the first or second fulcrum bearing surfaces will result in the second section of the actuation lever engaging and depressing the valve actuation button. Accordingly, the actuation mechanism lever first section can be pivoted upwardly whereby the lever will pivot about the first fulcrum bearing surface. Or, the lever first section can be pivoted downwardly whereby the lever third section will pivot about second fulcrum bearing surface.

The "T" shaped third section of the actuation lever provides lateral extension to the lever which serve to minimize lateral movement of the lever.

Although the plate 1248 has been included to provide the fulcrum bearing surfaces, it is understood that the bottom surface of the table top could have been provided the same fulcrum bearing surfaces. Additionally, the opening 1244 could have provided a top surface which would have provided the first fulcrum bearing surface. This was previously shown in FIG. 1. Were this the case, the first section of the lever would not need to be angled downwardly. The open slot 1244 allows the actuation lever to be easily installed within the table top support.

The first and second substantially upright surfaces 1242 and 1243 could have been disposed on the table top support in parallel planes. Such a table top support having four upright surfaces has been previously shown. Alternatively, the plate 1248 could have included a downwardly extending fulcrum bearing surface.

Figure 12C:
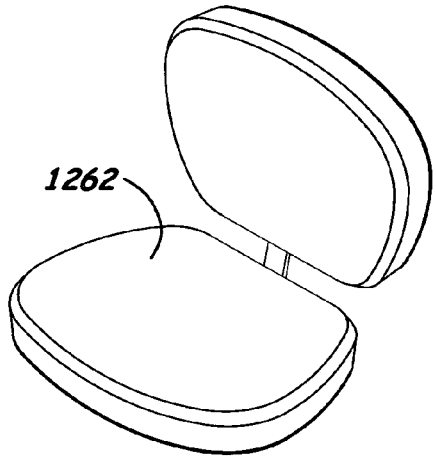
FIG. 12C is a side view of a chair seat for use with the invention as shown in FIG. 12B.

FIG. 12C shows a chair seat 1262 which may be used in place of the table top 1260 in this version of the invention.

Figure 13:
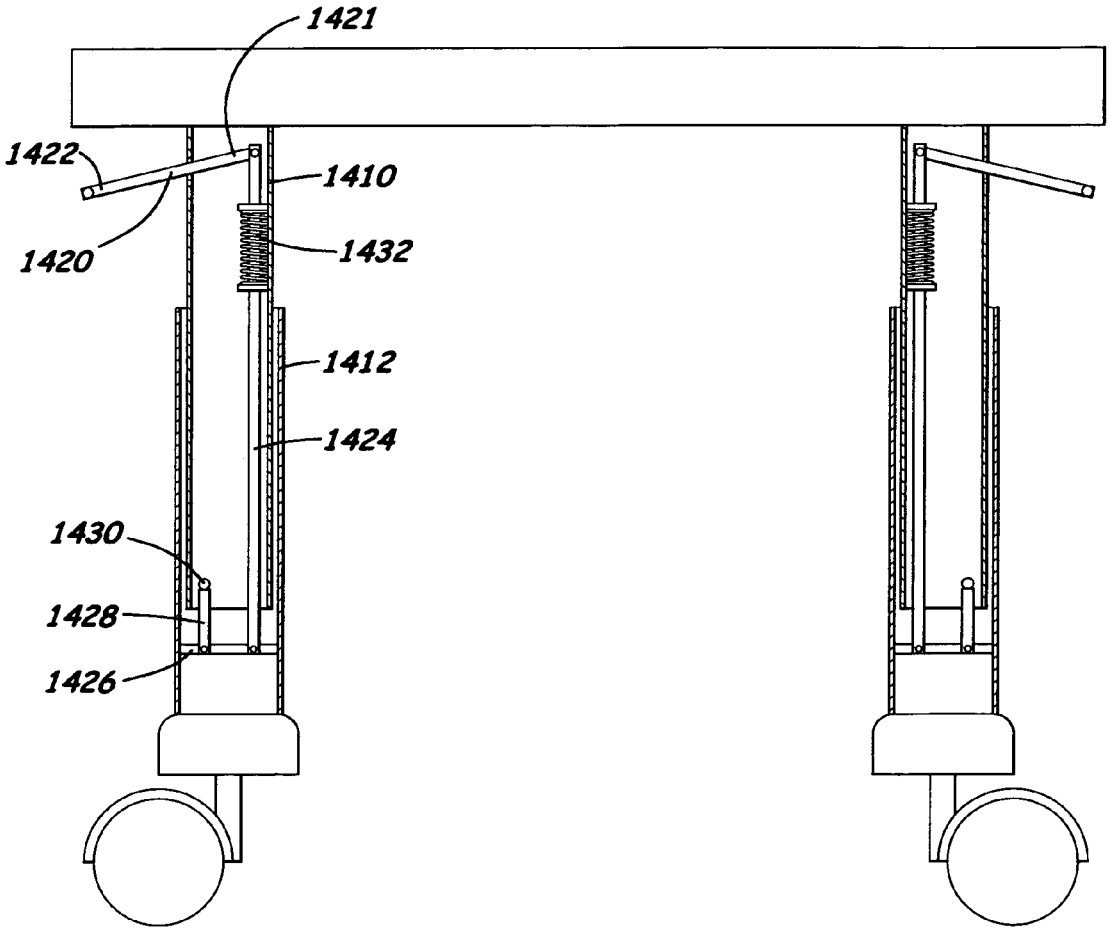
FIG. 13 is a side view of another version of the invention.
Figure 14:
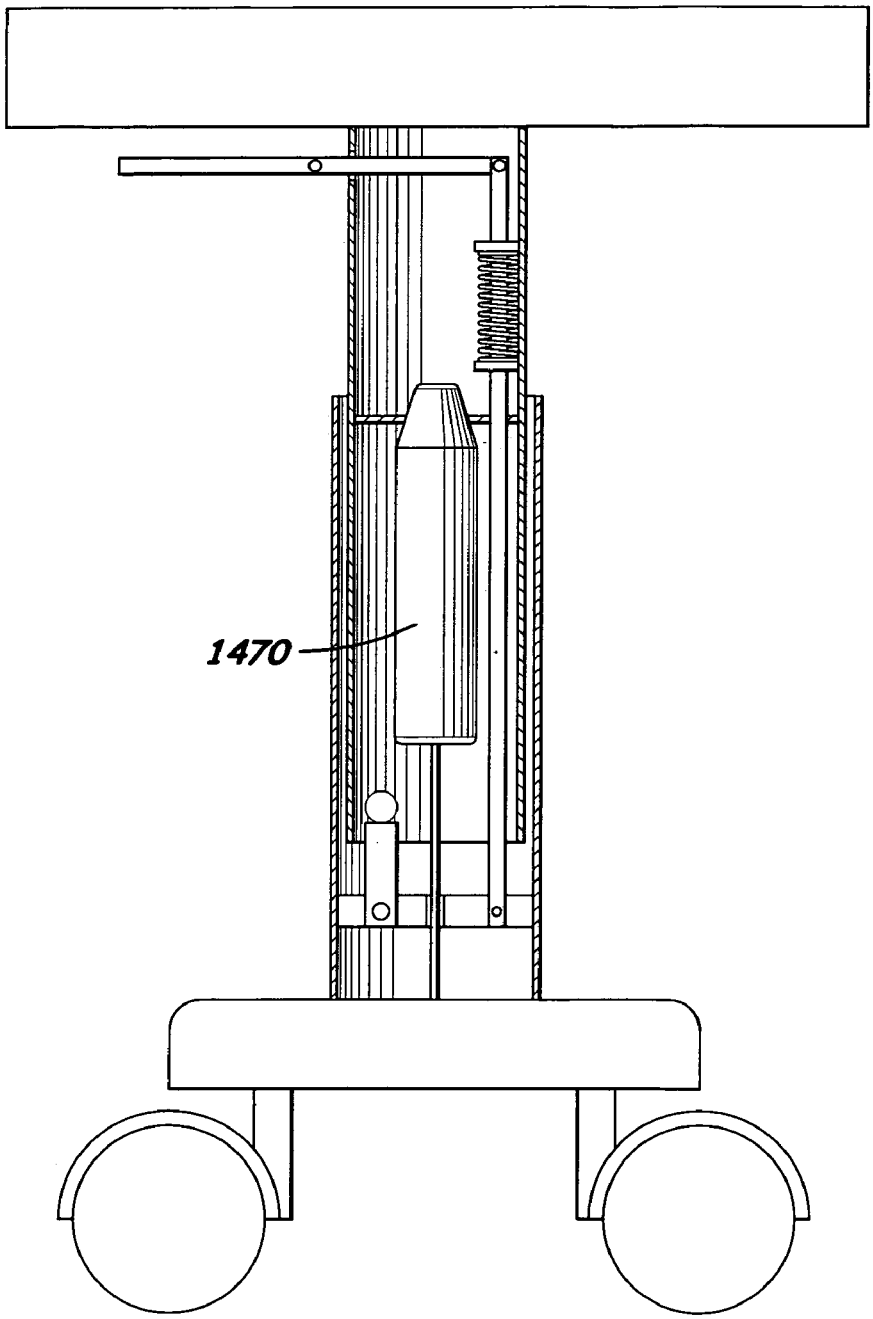
FIG. 14 is a side view of the version of the invention of FIG. 13 showing the addition of a gas spring.

FIG. 13 shows a locking mechanism which can be used for telescoping legs that do not include gas spring assistance. FIG. 14 shows the same locking mechanism used with non-locking gas springs.

In greater detail, FIG. 13 shows both legs having independent locking mechanisms which lock the position of an upper telescoping leg section 1310 to a lower leg section 1312. A toggle lever handle 1320 which when raised will pivot about a fulcrum 1322, which is provided by an opening in the top leg section. This causes the second end 1321 of the toggle lever to lower. The second end of the toggle lever is attached to a vertical rod 1324 which will also move downwardly under the upward force applied to the toggle lever handle. A plate 1326 which mates with the inside surface of the lower leg will pivot downwardly at the point where the vertical rod attaches to the plate. The other side of the plate 1326 is attached to the upper leg through a vertical tab 1328 which pivots on a pin 1330 also attached to the upper leg.

Once the plate is pivoted, the plate 1326 will no longer frictionally bind with the inside of the lower leg section 1312. This allows the table top to be adjusted vertically by lifting the table top or pressing downward on the table top. Once the new desired position is achieved, the levers are released. Upon releasing the levers, spring 1332, which surrounds the vertical rod, applies an upward force on the vertical rod which cause the rod to rise vertically. This vertical movement of the rod will cause the plate to move toward a horizontal position where the plates will bind within the lower leg sections. This locks the top telescoping leg section to the lower leg section.

The plate includes a rounded edge to assist in the wedging of the plate within the lower leg section. Alternatively, the plate could engage slots or serrations that are disposed on the lower leg section. The plate could be of any shape that would allow the plate to mate securely with the inside of the lower leg section. A connecting bar could be used to connect the levers of FIG. 13 in a manner previously shown.

In FIG. 14, a non-locking telescoping gas spring 1470 is used to assist in vertical adjustment of the table top. Accordingly, once the table is unlocked through the use of the toggle lever, the gas spring is able to move the table top vertically upward until the gas springs reach full extension or until the user releases the locking mechanisms. Lifting assistance may be required by the user depending on the gas springs used as well as the weight of any objects on the table top. Similarly, lowering the table requires the releasing of the locking mechanism by use of the toggle lever, and the subsequent application of a downward force on the table top which is sufficient to overcome the force of the gas spring.

Figure 15:
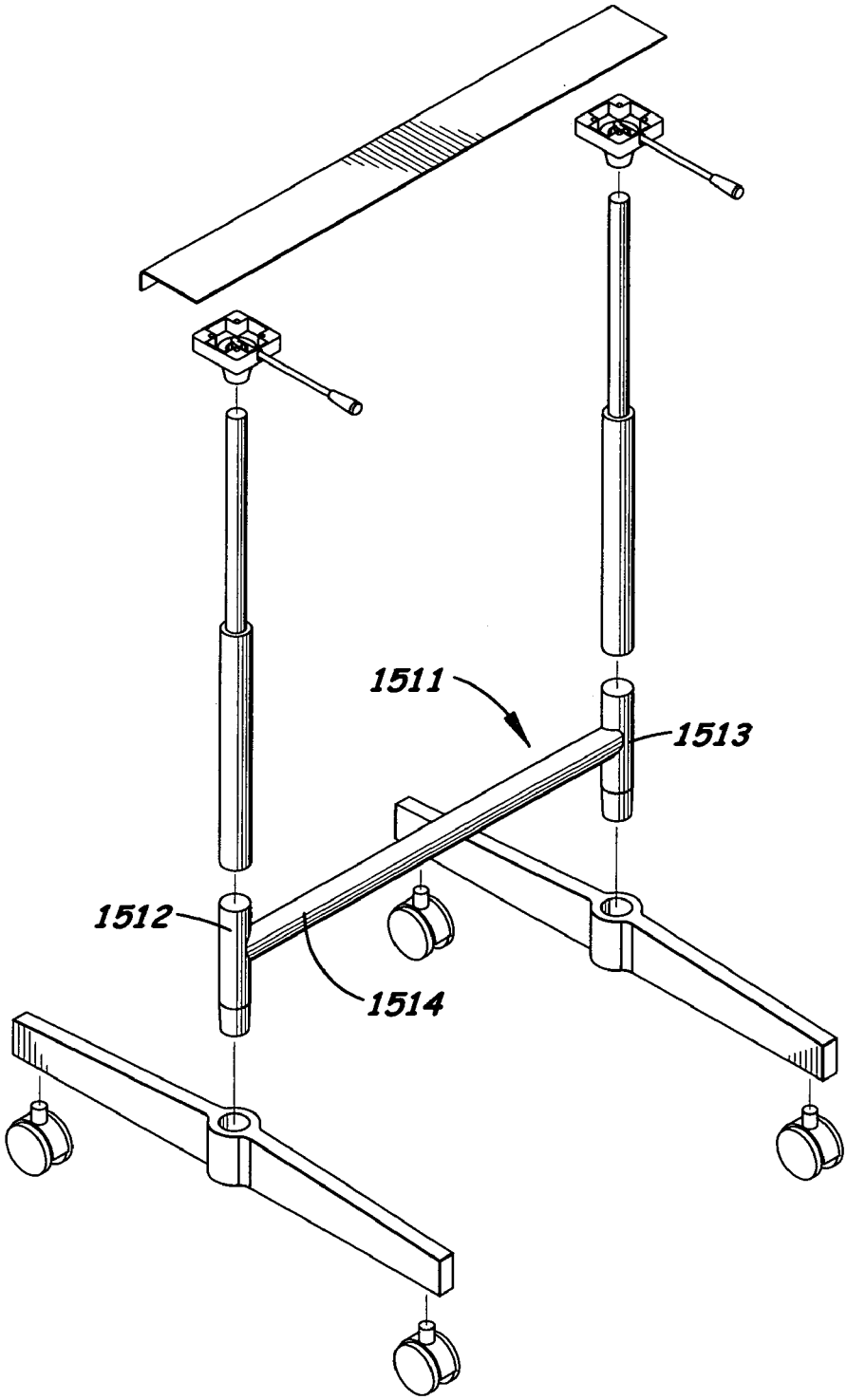
FIG. 15 is a perspective view of a version of the invention showing a hub extension assembly.

FIG. 15 shows the inclusion of a hub extension device 1511 into the first and second height adjustable columns. The hub extension device 1511 includes a first hub extension 1512, a second hub extension 1513, and a connector 1514. The hub extension add height to the height adjustable columns.

Alternative versions of the invention which are not specifically shown in drawing figures include the use of mechanisms other than a knob (as was shown in FIGS. 5A, 5B and 5C) which will support the connecting bar in an elevated position. Such mechanisms include latches, catches, etc., which allow the user to secure the connecting bar in the elevated position which actuates the gas springs for allowing vertical adjustment of the table top.

Many of the included versions of the invention include an actuation handle or knob above each of the gas springs used in the pedestal. In each of these versions a connecting bar may be included for transferring the movement at one handle or knob to the other handle or knob. For this reason, in those versions where a connecting bar is used, the user would only need to engage one of the handles or knobs to actuate the gas springs and vertically adjust the table top. This simplifies the height adjustment process significantly. This design also allows height adjustment to be performed by those who may be physically impaired and only have use of one arm. The design also allows for the exclusion of one of the handles or knobs if so desired.

The actuation mechanisms provide significant ergonomic benefits to height adjustable tables using locking telescoping spring mechanisms. The actuation mechanisms are designed for placement on the table at positions which are convenient for the user. The actuation mechanisms are very simple in use. Users of height adjustable chairs will readily understand the operation of the tables. The actuation mechanisms are also designed so that the shape of the elements within the mechanism which will be handled by the user are designed to accommodate the movement that the user will perform while operating the actuation mechanism. For example, if the user will be assisting the telescoping spring mechanism while the mechanisms are being actuated, the actuation mechanism is designed to allow the user to grasp ergonomic designed handles on the actuation mechanism which are in a proper position for the user to simultaneously actuate the telescoping spring mechanism and assist the lifting the table top. Similarly, if the user will be pressing downward on the table top while actuating the telescoping spring mechanisms, the ergonomic designed handles are designed to allow the user to perform both functions simultaneously.

There is also an alternative method of using the versions of the actuation mechanism that include a knob or other mechanism to support the connecting bar in the elevated position so that both gas springs are actuated. This alternative method involves maintaining the gas springs in the actuated condition through the use of the knob or other mechanism which raises the connecting bar of the actuation mechanism. As the gas springs would always be actuated and would be pushing upwardly on the table top, the weight pushing downward on the springs would have to be sufficient to balance the upward force of the gas springs.

The weight pushing downward could be in the table top itself or could be objects such as computer equipment placed on the table top. This downward force does not have to equal the upward force of the gas springs exactly, as frictional forces within the gas spring mechanisms also are acting on the gas spring mechanisms and must be overcome for movement of the gas spring mechanism to commence. For example, if two forty pound gas springs were used, a table top with a weight of 60 pounds would remain in a stationary vertical position with the gas springs actuated until the user applied an upward or downward force on the table top to move it to a new position. As the gas springs in this situation are always in the actuated condition, the user would not have to actuate the gas springs manually for this table top height adjustment to occur. Similarly, two thirty pound gas springs could be sufficiently balanced by a thirty pound table top and forty pounds of computer equipment.

Interestingly, the upward or downward force applied by the user to move the table when used in this way needs to be applied proximate to middle of the table top. A force applied between or adjacent the position of the gas springs will cause the desired movement of the table top to occur. A force applied at the front of the table top (which is the typical work location of the table user) would have no effect on the gas springs and would not cause movement of the table top. For this reason, using the actuation mechanism of the table in this way does not cause unwanted movement of the table top during actual use. Vertical movement of the table top occurs only when an adjustment to the height of the table top is desired The various versions of the invention have been shown height adjustable columns which comprise commercially available gas spring and stand tube assemblies. Such a gas spring and stand tube assembly was shown in FIG. 2. It is understood that height adjustable columns which do not require a stand tube to support the gas spring may also be used. Such gas springs would obviously be of a stronger construction than that shown in FIG. 2.

The height adjustment lever of FIGS. 12A and 12B would of course be usable in place of the height adjustment levers shown in each of the versions of the invention. Similarly, the height adjustable columns and actuation mechanisms shown in co-pending application 09/348,618 which is incorporated herein are also usable within the versions of the invention disclosed herein.

These are only an example of possible variations in the design and use of the height adjustable pedestals and tables of the present invention.

It is understood that other various modifications and changes in form or detail could readily be made without departing from the spirit of the invention. Many modifications have been previously mentioned within the description of the invention. It is therefore intended that the invention be not limited to the exact form and detail herein shown and described, nor to anything less than the whole of the invention herein disclosed and as hereinafter claimed.

I claim:

1. A user height adjustable table comprising:

a table top comprising a top surface and a bottom surface;

a first and a second lockable height adjustable mechanism, wherein each lockable height adjustable mechanism comprises at least one height adjustment mechanism; wherein each height adjustment mechanism can move;

wherein said table top is disposed above and is supported by each lockable height adjustable mechanism;

at least one movable locking mechanism; wherein each movable locking mechanism is selectively movable from a first locked position to a second unlocked position; wherein when each movable locking mechanism is moved to said unlocked position, each height adjustment mechanism can move, wherein each lockable height adjustable mechanism is actuated;

wherein said user height adjustable table comprises a floor contacting lower portion, and an upper portion supported by said floor contacting lower portion; wherein said upper portion can move upwardly and downwardly relative to said lower portion; wherein an upward or downward force applied to said upper portion can cause said table top to be moved relative to said floor contacting lower portion and the floor;

wherein one said height adjustment mechanism comprises movable resilient spring material which can apply upward force to said upper portion; wherein upon actuation of said first and said second lockable height adjustable mechanisms, said resilient spring material can resiliently move resulting in moving said upper portion upwardly away from said floor contacting lower portion and the floor unless said upper portion supplies sufficient compressive force;

wherein at least said table top comprises said upper portion;

wherein said table top comprises a length and a depth; wherein said lockable height adjustable mechanisms are disposed in line with said length, orthogonal and parallel to said depth;

an actuation mechanism supported on said user height adjustable table for moving each movable locking mechanism; wherein said actuation mechanism is disposed proximate said table top, and wherein when moved, said actuation mechanism can move each movable locking mechanism at least to said second unlocked position wherein each lockable height adjustable mechanism is actuated;

a first pushing surface; a second pushing surface; a first pulling surface; a second pulling surface; wherein each of said first and said second pushing and pulling surfaces are disposed on said upper portion;

wherein when said first and said second lockable height adjustable mechanisms are actuated, the hands of a table user can apply a downward force to said first and said second pushing surfaces wherein said upper portion can be moved downwardly toward said floor contacting lower portion wherein the height of said table top is adjusted relative to the floor, and wherein the hands of a table user can apply an upward force to said first and said second pulling surfaces wherein said upper portion can be moved upwardly away from said floor contacting lower portion wherein the height of said table top is adjusted relative to the floor;

wherein said actuation mechanism is disposed proximate said first pushing surface and said first pulling surface;

wherein a table user can contact and move said actuation mechanism with at least one hand, while simultaneously applying downward force to said first pushing surface with that same hand and downward force to said second pushing surface with user's other hand; wherein said table user can actuate said first and said second lockable height adjustable mechanisms with both hands positioned substantially above said table top while simultaneously applying downward force to said first and said second pushing surfaces; wherein the height of said table top can be adjusted downwardly toward said floor contacting lower portion and the floor;

wherein a table user can contact and move said actuation mechanism with at least one hand, while simultaneously applying upward force to said first pulling surface with that same hand and upward force to said second pulling surface with user's other hand; wherein said table user can actuate said first and said second height adjustable mechanisms with both hands positioned substantially above said table top while simultaneously applying upward force to said first and said second pulling surfaces; wherein the height of said table top can be adjusted upwardly away from said floor contacting lower portion and the floor;

wherein upon actuation of said first and said second lockable height adjustable mechanisms when said upper portion is moved upwardly away from said lower portion, a supply of sufficient downward compressive force by said upper portion can cause said upper portion to move downward toward said floor contacting lower portion and the floor;

wherein said lockable height adjustable mechanism must be actuated to adjust the height of said table top relative to said floor contacting lower portion and the floor.

2. The user height adjustable table of claim 1, wherein said actuation mechanism comprises at least one movable hand contact surface; wherein at least one said movable hand contact surface extends above said top surface of said table top;

wherein each movable hand contact surface, when moved, can result in moving at least one said movable locking mechanism from said first locked position to said second unlocked position resulting in actuating at least one of said first and said second lockable height adjustable mechanisms; wherein a hand of the table user can contact and move either of each hand contact surface while simultaneously applying either upward or downward force to said upper portion with each hand while at least one hand is positioned above said top surface of said table top.

3. The user height adjustable table of claim 1, comprising at least one knob disposed on said table top proximate said actuation mechanism.

4. The user height adjustable table of claim 3, wherein at least one said knob comprises a threaded knob extension stem which can be threadedly attached to said user height adjustable table, and when attached and threadedly moved, can move at least one said movable locking mechanism from said first locked position to said second unlocked position resulting in actuating at least one of said first and said second lockable height adjustable mechanisms.

5. The user height adjustable table of claim 1, wherein at least one said height adjustment mechanism comprises at least first and second telescoping sections; wherein said second telescoping section is disposed above each respective first telescoping section; and wherein said second telescoping section can move toward and away from each respective first telescoping section; wherein each second telescoping section comprises said upper portion.

6. The user height adjustable table of claim 1, wherein said first pulling and pushing surfaces, and said second pulling and pushing surfaces are disposed proximately collinear said first and said second height adjustable mechanisms.

7. The user height adjustable table of claim 1, wherein said table top comprises a periphery comprising first and second opposing ends defining said length of said table top;

wherein said periphery comprises opposing ends defining said depth, wherein said opposing ends are disposed perpendicular a line drawn between said first and said second opposing ends; wherein said first pulling and pushing surfaces and said second pulling and pushing surfaces are disposed proximate said first and said second opposing ends respectively; wherein said first and said second pulling and pushing surfaces and said first and said second height adjustable mechanisms are disposed at a significant distance from said opposing ends defining said depth.

8. The user height adjustable table of claim 1, wherein each lockable height adjustable mechanism comprises a lockable height adjustable column; wherein each height adjustment mechanism comprises a telescoping height adjustment mechanism; wherein each movable locking mechanism comprises a movable actuation button, wherein each movable actuation button comprises the first end portion of a movable stem; wherein said movable stem comprises first and second end portions.

9. The user height adjustable table of claim 1, wherein each of said first and said second lockable height adjustable mechanisms comprises at least one said movable locking mechanism;

wherein said actuation mechanism comprises a first section disposed proximate said first height adjustable mechanism, and a second section disposed proximate said second height adjustable mechanism; and at least one bearing surface upon which said actuation mechanism can move;

wherein said first section comprises a first height adjustment lever; wherein said first height adjustment lever extends from a position proximate each movable locking mechanism comprising said first lockable height adjustable mechanism at least to one said bearing surface;

wherein said second section comprises a second height adjustment lever; wherein said second height adjustment lever extends from a position proximate each movable locking mechanism comprising said second lockable height adjustable mechanism at least to one said bearing surface;

wherein said first height adjustment lever is selectively movable from a first position to a second position; wherein said second position moves each movable locking mechanism comprising at least said first lockable height adjustable mechanism at least to said second unlocked position;

wherein said second height adjustment lever is selectively movable from a first position to a second position; wherein said second position moves each movable locking mechanism comprising at least said second lockable height adjustable mechanism at least to said second unlocked position.

10. The user height adjustable table of claim 9, wherein said first and said second height adjustment levers are connected for synchronous actuation.

11. The user height adjustable table of claim 9, wherein said first and said second height adjustment levers are disposed substantially parallel each other and extend perpendicular to a line drawn between said first and said second height adjustable mechanisms.

12. The user height adjustable table of claim 9, wherein said first and said height adjustment levers are disposed coaxial each other.

13. The user height adjustable table of claim 1, comprising means to hold said actuation mechanism in a position which holds at least one movable locking mechanism in said second unlocked position.

14. The user height adjustable table of claim 1, wherein at least one said height adjustment mechanism comprises a lockable height adjustment mechanism comprising one said movable locking mechanism.

15. The user height adjustable table of claim 1, wherein said movable resilient spring material comprises pressurized gas.

16. The user height adjustable table of claim 1, wherein at least one said height adjustment mechanism comprises a locking gas spring; wherein each locking gas spring comprises; a cylinder; a piston rod disposed within said cylinder and extending therefrom to a secured position opposite said cylinder in one said height adjustable mechanism; a movable resilient spring material comprising pressurized gas disposed within said cylinder which can apply substantial upward force to said upper portion; a fluid flow control valve comprising a movable fluid flow control valve stem extending outwardly from said locking gas spring; and one said movable locking mechanism, wherein said movable locking mechanism comprises the top portion of said movable fluid flow control valve stem; wherein said one said movable locking mechanism can be moved from said first locked position to said second unlocked position; wherein said unlocked position allows relative longitudinal movement between said cylinder and said piston.

17. The user height adjustable table of claim 5, wherein said one said height adjustment mechanism comprises a lockable height adjustment mechanism comprising one said movable locking mechanism which when moved can cause said first and said second telescoping sections to become mated with each other wherein said second section is prevented from moving toward and away from said first section; and wherein when mated, said one said movable locking mechanism can be moved causing said first and said second sections to become unmated, wherein said second section can move toward and away from said first section.

18. The user height adjustable table of claim 1, wherein said actuation mechanism comprises at least one movable hand contact surface; wherein each movable hand contact surface extends above said top surface of said table top;

wherein each movable hand contact surface, when moved, can result in moving at least one said movable locking mechanism from said first locked position to said second unlocked position resulting in actuating at least one of said first and said second lockable height adjustable mechanisms; wherein a hand of the table user can contact and move either of each hand contact surface while simultaneously applying either upward or downward force to said upper portion with each hand while each hand is positioned above said top surface of said table top.

19. The user height adjustable table of claim 1, wherein said top surface of said table top comprises at least one opening providing access to one said pulling surface.

20. The user height adjustable table of claim 19, wherein at least one said opening extends through said bottom surface.

21. The user height adjustable table of claim 19, wherein at least one said opening is disposed proximate said actuation mechanism.

22. The user height adjustable table of claim 1, wherein said actuation mechanism is disposed proximate said first and said second pushing surfaces.

23. The user height adjustable table of claim 22, wherein said actuation mechanism is disposed proximate said first pulling surface and said second pulling surface.

24. The user height adjustable table of claim 1, wherein said actuation mechanism is disposed proximate said first and said second pulling surfaces.

25. The user height adjustable table of claim 1, wherein said actuation mechanism is disposed proximate said second pushing surface.

26. The user height adjustable table of claim 1, wherein said actuation mechanism can only be moved upwardly and downwardly.

27. The user height adjustable table of claim 1, wherein at least one said height adjustable mechanism comprises at least one non-locking telescoping gas spring; wherein each non-locking telescoping gas spring comprises a cylinder; a piston rod disposed within said cylinder and extending therefrom to a secured position opposite said cylinder in one said height adjustable mechanism; a movable resilient spring material comprising pressurized gas disposed within said cylinder; a fluid flow control valve; wherein one of said piston rod and said cylinder comprises said floor contacting lower portion.

28. A user height adjustable table comprising:

a table top comprising a top surface and a bottom surface;

a first and a second lockable height adjustable mechanism; wherein each lockable height adjustable mechanism comprises at least one height adjustment mechanism; wherein each height adjustment mechanism can move;

at least one movable locking mechanism; wherein each movable locking mechanism is selectively movable from a first locked position to a second unlocked position; wherein when each movable locking mechanism is moved to said unlocked position, each height adjustment mechanism can move, wherein each height adjustable mechanism is actuated;

wherein said table top is disposed above and is supported by each lockable height adjustable mechanism;

wherein said user height adjustable table comprises a floor contacting lower portion, and an upper portion supported by said floor contacting lower portion; wherein said upper portion can move upwardly and downwardly relative to said lower portion;

wherein at least said table top comprises said upper portion;

wherein an upward or downward force applied to said upper portion can cause said table top to be moved relative to said floor contacting lower portion and the floor;

an actuation mechanism supported on said user height adjustable table for moving each movable locking mechanism; wherein said actuation mechanism is disposed proximate said table top, and wherein when moved, said actuation mechanism can move each movable locking mechanism at least to said second unlocked position; wherein the height of said table top can be adjusted relative to said floor contacting lower portion and the floor;

wherein said actuation mechanism comprises at least one movable hand contact surface; wherein at least one said movable hand contact surface extends above said top surface of said table top;

wherein each movable hand contact surface, when moved, can result in moving at least one said movable locking mechanism from said first locked position to said second unlocked position resulting in actuating at least one of said first and said second lockable height adjustable mechanisms; wherein a hand of the table user can contact and move each hand contact surface while simultaneously applying either upward or downward force to said upper portion with each hand while at least one hand is positioned above said top surface of said table top.

29. The user height adjustable table of claim 28, wherein at least one said height adjustment mechanism comprises movable resilient spring material which can apply upward force to said upper portion.

30. A user height adjustable table comprising:

a table top comprising a top surface and a bottom surface;

a first and a second lockable height adjustable mechanism; wherein each lockable height adjustable mechanism comprises at least one height adjustment mechanism; wherein each height adjustment mechanism can move;

at least one movable locking mechanism; wherein each movable locking mechanism is selectively movable from a first locked position to a second unlocked position; wherein when each movable locking mechanism is moved to said unlocked position, each height adjustment mechanism can move, wherein each height adjustable mechanism is actuated;

wherein said table top is disposed above and is supported by each lockable height adjustable mechanism;

wherein said user height adjustable table comprises a floor contacting lower portion, and an upper portion supported by said floor contacting lower portion; wherein said upper portion can move upwardly and downwardly relative to said lower portion;

wherein at least said table top comprises said upper portion;

wherein an upward or downward force applied to said upper portion can cause said table top to be moved relative to said floor contacting lower portion and the floor;

an actuation mechanism comprising said upper portion for moving each movable locking mechanism; wherein when moved, said actuation mechanism can move each movable locking mechanism at least to said second unlocked position; wherein the height of said table top can be adjusted relative to said floor contacting lower portion and the floor;

wherein said top surface of said table top comprises at least one opening.

31. The user height adjustable table of claim 30, wherein at least one said opening extends through said bottom surface.

32. A user height adjustable table comprising:

a table top;

a first and a second lockable height adjustable mechanism wherein each lockable height adjustable mechanism comprises at least one height adjustment mechanism; wherein each height adjustment mechanism can move;

at least one movable locking mechanism; wherein each movable locking mechanism is selectively movable from a first locked position to a second unlocked position; wherein when each movable locking mechanism is moved to said unlocked position, each height adjustment mechanism can move, wherein each height adjustable mechanism is actuated;

wherein said table top is disposed above and is supported by each lockable height adjustable mechanism;

wherein said user height adjustable table comprises a floor contacting lower portion, and an upper portion supported by said floor contacting lower portion; wherein said upper portion can move upwardly and downwardly relative to said lower portion;

wherein at least said table top comprises said upper portion;

wherein an upward or downward force applied to said upper portion can cause said table top to be moved relative to said floor contacting lower portion and the floor;

an actuation mechanism supported on said user height adjustable table for moving each movable locking mechanism; wherein said actuation mechanism is disposed proximate said table top; and wherein when moved, said actuation mechanism can move each movable locking mechanism at least to said second unlocked position; wherein the height of said table top can be adjusted relative to said floor contacting lower portion and the floor;

wherein said actuation mechanism can move in at least two opposite directions actuating each movable locking mechanism, wherein movement in any of said opposite directions results in moving at least one said movable locking mechanism movable locking mechanism to said second unlocked position; wherein said actuation mechanism comprises a cam lever comprising a lever comprising an eccentrically mounted cam; wherein said cam lever can move in at least two opposite directions; wherein said cam lever is disposed between at least two bearing surfaces and at least one said movable locking mechanism; wherein said cam lever can rotate in one direction against at least two said bearing surfaces while projecting away from at least two said bearing surfaces resulting in moving at least one said movable locking mechanism to said second unlocked position; and wherein said lever can rotate in an opposite direction against at least two said bearing surfaces while projecting away from at least two said bearing surfaces resulting in moving at least one said movable locking mechanism to said second unlocked position.

33. A user height adjustable table comprising:

a table top;

a first and a second lockable height adjustable mechanism wherein each lockable height adjustable mechanism comprises at least one height adjustment mechanism; wherein each height adjustment mechanism can move;

at least one movable locking mechanism; wherein each movable locking mechanism is selectively movable from a first locked position to a second unlocked position; wherein when each movable locking mechanism is moved to said unlocked position, each height adjustment mechanism can move, wherein each height adjustable mechanism is actuated;

wherein said table top is disposed above and is supported by each lockable height adjustable mechanism;

wherein said user height adjustable table comprises a floor contacting lower portion, and an upper portion supported by said floor contacting lower portion; wherein said upper portion can move upwardly and downwardly relative to said lower portion;

wherein at least said table top comprises said upper portion;

wherein an upward or downward force applied to said upper portion can cause said table top to be moved relative to said floor contacting lower portion and relative to the floor;

an actuation mechanism supported on said user height adjustable table for moving each movable locking mechanism; wherein said actuation mechanism is disposed proximate said table top, and wherein when moved, said actuation mechanism can move each movable locking mechanism at least to said second unlocked position; wherein the height of said table top can be adjusted relative to said floor contacting lower portion and the floor;

wherein said actuation mechanism can move in at least two opposite directions actuating each movable locking mechanism, wherein movement in any of said opposite directions results in moving at least one said movable locking mechanism to said second unlocked position; wherein said actuation mechanism comprises a lever disposed between at least two fulcrum bearing surfaces and at least one said movable locking mechanism; wherein in a first direction, said lever can pivot against at least a first of said at least two fulcrum bearing surfaces away from at least a second of said fulcrum bearing surfaces resulting in moving at least one said movable locking mechanism to said second unlocked position; and in a second direction, said lever can pivot against any other of said at least two fulcrum bearing surfaces away from at least said first fulcrum bearing surface resulting in moving at least one said movable locking mechanism to said second unlocked position.

34. A user height adjustable table comprising:

a table top comprising a top surface;

a first and a second lockable height adjustable mechanism; wherein each lockable height adjustable mechanism comprises at least one height adjustment mechanism; wherein each height adjustment mechanism can move;

at least one movable locking mechanism; wherein each movable locking mechanism is selectively movable from a first locked position to a second unlocked position; wherein when each movable locking mechanism is moved to said unlocked position, each height adjustment mechanism can move, wherein each height adjustable mechanism is actuated;

wherein said table top is disposed above and is supported by each lockable height adjustable mechanism;

wherein said user height adjustable table comprises a floor contacting lower portion, and an upper portion supported by said floor contacting lower portion; wherein said upper portion can move upwardly and downwardly relative to said lower portion;

wherein at least said table top comprises said upper portion;

wherein an upward or downward force applied to said upper portion can cause said table top to be moved relative to said floor contacting lower portion and the floor;

an actuation mechanism supported on said user height adjustable table for moving each movable locking mechanism; wherein said actuation mechanism is disposed proximate said table top, and wherein when moved, said actuation mechanism can move each movable locking mechanism at least to said second unlocked position; wherein the height of said table top can be adjusted relative to said floor contacting lower portion and the floor;

at least one knob disposed on said table top; wherein a table user can push or pull each knob applying an upward or downward force to said upper portion.

35. The user height adjustable table of claim 34, wherein at least one said knob comprises a threaded knob extension stem which can be threadedly attached to said user height adjustable table, and when attached, and threadedly moved, can move at least one said movable locking mechanism from said first locked position to said second unlocked position resulting in actuating at least one of said first and said second lockable height adjustable mechanisms.

36. A user height adjustable table comprising:

a table top;

a first and a second lockable height adjustable mechanism; wherein each lockable height adjustable mechanism comprises at least one height adjustment mechanism; wherein each height adjustment mechanism can move;

wherein said table top is disposed above and is supported by each lockable height adjustable mechanism;

wherein said user height adjustable table comprises a floor contacting lower portion, and an upper portion supported by said floor contacting lower portion; wherein said upper portion can move upwardly and downwardly relative to said lower portion;

wherein at least said table top comprises said upper portion;

wherein an upward or downward force applied to said upper portion can cause said table top to be moved relative to said floor contacting lower portion and the floor;

wherein said first and said second height adjustable mechanisms comprise resilient spring material which can apply upward force to said upper portion;

wherein at least one said height adjustable mechanism comprises at least one non-locking telescoping gas spring; wherein each non-locking telescoping gas spring comprises a cylinder; a piston rod disposed within said cylinder and extending therefrom to a secured position opposite said cylinder in one said height adjustable mechanism; a movable resilient spring material comprising pressurized gas disposed within said cylinder; a fluid flow control valve; wherein one of said piston rod and said cylinder comprises said floor contacting lower portion;

wherein said upper portion comprises means for locking and unlocking said first and said second lockable height adjustable mechanisms, wherein when unlocked said lockable height adjustable mechanisms are actuated;

wherein any downward force applied to said upper portion is transferred to said floor contacting lower portion; wherein the height of said table top can be adjusted relative to said floor contacting lower portion and the floor.

37. A user height adjustable table comprising:

a table top comprising a top surface and a bottom surface;

a first and a second lockable height adjustable mechanism; wherein each lockable height adjustable mechanism comprises at least one height adjustment mechanism; wherein each height adjustment mechanism can move; wherein said table top is disposed above and is supported by each lockable height adjustable mechanism;

wherein said user height adjustable table comprises a floor contacting lower portion, and an upper portion supported by said floor contacting lower portion; wherein said upper portion can move upwardly and downwardly relative to said lower portion;

wherein at least said table top comprises said upper portion;

wherein each height adjustment mechanism comprises a non-locking telescoping gas spring; wherein each non-locking telescoping gas spring comprises a cylinder; a piston rod disposed within said cylinder and extending therefrom to a secured position opposite said cylinder in one said lockable height adjustable mechanism; a movable resilient spring material comprising pressurized gas disposed within said cylinder which can apply upward force to said upper portion; a fluid flow control valve; wherein one of said piston rod and said cylinder comprises said floor contacting lower portion;

wherein an upward or downward force applied to said upper portion can cause said table top to be moved relative to said floor contacting lower portion and the floor;

wherein any downward force applied to said upper portion is transferred to said lower portion and wherein said table top remains at substantially the same angular relationship relative to said first and said second height adjustable mechanisms and relative to the floor at all times;

actuating means comprising said upper portion for locking and unlocking said first and said second lockable height adjustable mechanisms, wherein when unlocked said lockable height adjustable mechanisms are actuated;

wherein when actuated, said table top can be adjusted in height relative to said floor contacting lower portion and the floor.

38. A user height adjustable table comprising:

a table top comprising a top surface and a bottom surface;

a first and a second lockable height adjustable mechanism; wherein each lockable height adjustable mechanism comprises at least one height adjustment mechanism; wherein each height adjustment mechanism can move; wherein said table top is disposed above and is supported by each lockable height adjustable mechanism;

wherein said user height adjustable table comprises a floor contacting lower portion, and an upper portion supported by said floor contacting lower portion; wherein said upper portion can move upwardly and downwardly relative to said lower portion;

wherein at least said table top comprises said upper portion;

wherein each height adjustment mechanism comprises a telescoping gas spring; wherein each telescoping gas spring comprises a cylinder; a piston rod disposed within said cylinder and extending therefrom to a secured position opposite said cylinder in one said lockable height adjustable mechanism; a movable resilient spring material comprising pressurized gas disposed within said cylinder which can apply substantial upward force to said upper portion; a fluid flow control valve; wherein one of said piston rod and said cylinder comprises said floor contacting lower portion;

wherein at least one said telescoping gas spring comprises a locking gas spring; wherein said fluid flow control valve comprises a movable fluid flow control valve stem extending outwardly from said locking gas spring; and a movable locking mechanism, wherein said movable locking mechanism comprises the top portion of said movable fluid flow control valve stem; wherein said movable locking mechanism can be moved from a first locked position to a second unlocked position, wherein said unlocked position allows relative longitudinal movement between said cylinder and said piston;

wherein an upward or downward force applied to said upper portion can cause said table top to be moved relative to said floor contacting lower portion and the floor, wherein said floor contacting lower portion does not move vertically relative to the floor;

wherein any downward force applied to said upper portion is transferred to said lower portion and wherein said table top remains at substantially the same angular relationship relative to said first and said second height adjustable mechanisms and relative to the floor at all times;

actuating means comprising said upper portion for locking and unlocking said first and said second lockable height adjustable mechanisms, wherein when unlocked said lockable height adjustable mechanisms are actuated;

wherein when actuated, said table top can be adjusted in height relative to said floor contacting lower portion and the floor.

* * * * *